US008517513B2

(12) United States Patent
Fang et al.

(10) Patent No.: US 8,517,513 B2
(45) Date of Patent: Aug. 27, 2013

(54) INKJET PRINTHEADS AND FLUID EJECTING CHIPS

(75) Inventors: Jiandong Fang, Lexington, KY (US); Paul Graf, Lexington, KY (US)

(73) Assignee: Funai Electric Co., Ltd. (JP)

( * ) Notice: Subject to any disclaimer, the term of this patent is extended or adjusted under 35 U.S.C. 154(b) by 304 days.

(21) Appl. No.: 13/013,982

(22) Filed: Jan. 26, 2011

(65) Prior Publication Data

US 2012/0188308 A1 Jul. 26, 2012

(51) Int. Cl.
*B41J 2/14* (2006.01)
*B41J 2/16* (2006.01)

(52) U.S. Cl.
USPC ..... 347/49; 347/40; 347/44; 347/65

(58) Field of Classification Search
USPC ..... 347/40, 42–44, 48–50, 58–59, 65
See application file for complete search history.

(56) References Cited

U.S. PATENT DOCUMENTS 6,027,203 A * 2/2000 Campbell ..... 347/42
6,315,389 B1 * 11/2001 Torgerson et al. ..... 347/40
6,779,871 B1 * 8/2004 Seto et al. ..... 347/40

* cited by examiner

*Primary Examiner* — Thinh Nguyen
(74) *Attorney, Agent, or Firm* — Amster, Rothstein & Ebensten LLP

(57) ABSTRACT

Disclosed is an inkjet printhead that includes a plurality of fluid ejecting chips arranged in a plurality of rows. The plurality of fluid ejecting chips includes a first set of fluid ejecting chips arranged in a first row of the plurality of rows. The plurality of fluid ejecting chips includes a second set of fluid ejecting chips arranged in a second row parallel to the first row of the plurality of rows. Each fluid ejecting chip of the second set of fluid ejecting chips is configured between two consecutive fluid ejecting chips of the first set of fluid ejecting chips in a predetermined orientation. The inkjet printhead further includes a plurality of fluid vias and a plurality of bond pads. Further disclosed are fluid ejecting chips for being used in an inkjet printhead.

21 Claims, 12 Drawing Sheets

INKJET PRINTHEADS AND FLUID EJECTING CHIPS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to inkjet printheads, and more particularly, to inkjet printheads that provide long print swaths on a print medium.

2. Description of the Related Art

A typical inkjet printer includes an inkjet printhead that is allowed to pass multiple times across a width of a print medium (such as a paper/document to be printed) during a printing operation. The inkjet printhead may have thermal, piezoelectric or mechanical actuating fluid ejectors (fluid ejecting chips). On completion of the printing operation, a print on the print medium is defined as an established number of print swaths. As used herein the term, 'print swath' may relate to a stripe of print across the print medium that the inkjet printhead may create at a time. It has been observed that printing speed for a print medium is majorly affected by the length of a print swath (longer the print swath, higher the speed for printing the print medium). Various approaches have been devised to achieve a longer print swath. For example, lengths of fluid ejecting chips of an inkjet printhead may be increased for achieving a longer print swath. Further, arraying of multiple fluid ejecting chips in a line within an inkjet printhead may also assist in achieving a longer print swath.

Also, fluid ejecting chips of an inkjet printhead are generally fabricated in order to have rectangular shapes. A rectangular shape of a fluid ejecting chip assists in maximizing the available print swath while leading to a practical placement of electrical interconnects at respective long end portions of the fluid ejecting chip, i.e., along respective breadths of the fluid ejecting chip. Further, in a typical fluid ejecting chip, a top side encapsulant is used for protecting electrical interconnect bond pads and bond wires from a corrosive fluid (such as ink) environment that any inkjet printhead may experience during storage, service and maintenance thereof. The top side encapsulant is fabricated during circuit assembly of the inkjet printhead in a two-step process. Specifically, uncured liquid encapsulant is initially disposed over the bond pads and the bond wires with the help of an automated dispenser. Subsequently, a thermal cure process is used for curing/solidifying the dispensed liquid encapsulant.

FIG. 1 depicts a typical tri-color fluid ejecting chip 100 that is rectangular in shape and includes slotted fluid vias 102, 104 and 106. The fluid vias 102, 104 and 106 may be for colored fluids such as cyan, magenta and yellow, respectively. It should be understood that the fluid ejecting chip 100 may include any number of fluid vias for any colored fluid as desired. The fluid ejecting chip 100 includes a plurality of bond pads 112 configured at long end portions 122 and 124 of the fluid ejecting chip 100, i.e., along respective breadths of the fluid ejecting chip 100. Further, the fluid ejecting chip 100 includes a plurality of bond wires 132 that form electrical interconnects at the long end portions 122 and 124 of the fluid ejecting chip 100. The bond wires 132 connect power or control signals to the bond pads 112 that connect to respective fluid ejecting elements (not shown) configured adjacent to the fluid vias 102, 104 and 106 of the fluid ejecting chip 100. A protective encapsulant 142 seals any exposed fluid ejecting chip wiring, the bond wires 132 and power/control signal connection wiring from a fluid. Overcoat layers (not shown) protect the fluid ejecting chip and power/control signal wiring not covered by the encapsulant 142. As depicted in FIG. 1, 'D1' represents width of the top-side encapsulant, 'D2' represents length of the top-side encapsulant, and 'D3' represents length of a print swath that may be obtained by employing the fluid ejecting chip 100.

It has been observed that an encapsulant's profile and footprint have tolerances arising from many variable factors, such as a viscosity of the encapsulant, an alignment of the automated dispenser with respect to a fluid ejecting chip, such as the fluid ejecting chip 100, a location of the dispensed encapsulant, and expansion of the encapsulant during the thermal cure process. Further, arrangement of a plurality of fluid ejecting chips, such as the fluid ejecting chip 100, in an array of adjacent rows may result in significant footprint tolerance of the encapsulant, thereby challenging close tiling of the fluid ejecting chips required to achieve long print swaths and to minimize paper skew effects. Furthermore, it has been observed that location/position of bond pads is vital to the arrangement of the fluid ejecting chips, as the bond pads need to be configured appropriately in order to facilitate an easy fan-out of bond wires from the fluid ejecting chips to a circuit assembly substrate of an inkjet printhead. The term 'circuit assembly' as used herein above relates to the connection between a fluid ejecting chip, such as the fluid ejecting chip 100, and a printhead controller. Accordingly, the separation between the adjacent rows of the fluid ejecting chips, during fabrication, tends to increase, thereby making it difficult to tile the fluid ejecting chips closely and increasing the chances for paper skew print defects. The aforementioned aspect with regard to encapsulant tolerance and tiling of fluid ejecting chips is explained in conjunction with FIG. 2.

FIG. 2 is a schematic depiction of a wide swath inkjet printhead 200 that includes conventional fluid ejecting chips 220, 240 and 260. Each fluid ejecting chip of the fluid ejecting chips 220, 240 and 260 of the wide swath inkjet printhead 200 includes fluid vias configured therewithin and bond pads configured on respective long end portions. Specifically, the fluid ejecting chip 220 includes fluid vias 222, 224 and 226 for cyan, magenta and yellow colored-fluids (inks), respectively. Further, the fluid ejecting chip 220 includes a plurality of bond pads 228 configured at long end portions 230 and 232 thereof. Similarly, the fluid ejecting chip 240 includes fluid vias 242, 244 and 246 for cyan, magenta and yellow colored-fluids (inks), respectively. Further, the fluid ejecting chip 240 includes a plurality of bond pads 248 configured at long end portions 250 and 252 thereof. Further, the fluid ejecting chip 260 includes fluid vias 262, 264 and 266 for cyan, magenta and yellow colored-fluids (inks), respectively. Further, the fluid ejecting chip 260 includes a plurality of bond pads 268 configured at long end portions 270 and 272 thereof. For such an inkjet printhead 200, distance between fluid vias for the same colored-fluid (ink), such as the fluid vias 222 and 242, of consecutive fluid ejecting chips, such as the fluid ejecting chips 220 and 240, needs to be minimized in order to reduce the paper skew print defects. For example, distance 'D4' between the fluid vias 222 and 242 needs to be minimized in order to reduce the effects of paper skew on print quality. Further, 'D5' represents the length of encapsulant tolerance set for the inkjet printhead 200. FIG. 2 also depicts the direction of paper travel (depicted by arrow 'A') with respect to the alignment of the fluid ejecting chips 220, 240 and 260.

FIG. 3 depicts dot patterns to illustrate effects of paper skew on print quality. Specifically, FIG. 3 depicts a first dot pattern (depicted as 'Dot pattern 1') without any printhead skew, drop skew error and drop alignment error for a near row of a plurality of nozzles 310 and a far row of a plurality of nozzles 320. Further, FIG. 3 depicts a second dot pattern (depicted as 'Dot pattern 2') for a linear travel skew, i.e., the second dot pattern is associated with printhead skew, drop skew error and drop alignment error for the nozzles 310 and the nozzles 320. It may be observed that distance between the nozzles 310 and the nozzles 320, in the direction of paper travel (depicted by arrows 'B' and 'C') affects location of fluid drops on a paper (or any other print medium) in the presence of printhead skew, drop skew error and drop alignment error. The second dot pattern depicts that the printhead skew results in drop skew error where dots are skewed on the paper. In addition, dots from the near row of the nozzles 310 may incorrectly align with dots from the far row of the nozzles 320, thereby resulting in drop alignment error, as depicted in the second dot pattern.

FIG. 4 depicts a third dot pattern (depicted as 'Dot pattern 3') and a fourth dot pattern (depicted as 'Dot pattern 4') to illustrate the relation between nozzle distance and skew effects on drop location and print quality. Specifically, the third and the fourth dot patterns depict that nozzles, such as a plurality of nozzles 410 and plurality of nozzles 420, which are narrowly separated and have a large skew angle, eject drops that are disposed in a manner (in terms of respective locations) similar to that for nozzles, such as a plurality of nozzles 430 and a plurality of nozzles 440, which are widely separated and have a small skew angle. It may also be observed that greater nozzle-to-nozzle 115 distance between adjacent rows of an inkjet printhead intensifies the skew effects on drop location and print quality. Accordingly, the nozzle-to-nozzle distances between the adjacent rows need to be minimized in order to minimize effects of the skew angle on drop location and print quality. In FIG. 4, directions of paper travel are depicted by arrows 'D' and 'E'.

An alternate design of fluid ejecting chips in an inkjet printhead may be used for addressing the aforementioned problems associated with skew effects and close tiling of the fluid ejecting chips. FIG. 5 is a schematic depiction of an alternate design for an inkjet printhead. The inkjet printhead 500 includes a plurality of fluid ejecting chips arranged in a plurality of rows, such as a first row 502 and a second row 504. Each fluid ejecting chip of the plurality of fluid ejecting chips includes a first set of fluid ejecting chips, such as fluid ejecting chips 510 and 530, arranged in the first row 502 of the plurality of rows. Each fluid ejecting chip of the first set of fluid ejecting chips includes a first edge and a second edge opposite to the first edge. Specifically, the fluid ejecting chip 510 includes a first edge 512 and a second edge 514 opposite to the first edge 512. Similarly, the fluid ejecting chip 530 includes a first edge 532 and a second edge 534 opposite to the first edge 532. Further, the first edge and the second edge of the each fluid ejecting chip of the first set of fluid ejecting chips are longitudinal straight edges.

The plurality of fluid ejecting chips also includes a second set of fluid ejecting chips, such as fluid ejecting chips 550 and 570, arranged in the second row 504 of the plurality of rows. As depicted in FIG. 5, the second row 504 is parallel to the first row 502. Each fluid ejecting chip of the second set of fluid ejecting chips includes a first edge and a second edge opposite to the first edge. Specifically, the fluid ejecting chip 550 includes a first edge 552 and a second edge 554 opposite to the first edge 552. Similarly, the fluid ejecting chip 570 includes a first edge 572 and a second edge 574 opposite to the first edge 572. Further, the first edge and the second edge of the each fluid ejecting chip of the second set of fluid ejecting chips are longitudinal straight edges.

The each fluid ejecting chip of the second set of fluid ejecting chips is configured between two consecutive fluid ejecting chips of the first set of fluid ejecting chips in a predetermined orientation such that the second edge of the each fluid ejecting chip of the second set of fluid ejecting chips is in proximity to a respective second edge of a fluid ejecting chip of the two consecutive fluid ejecting chips of the first set of fluid ejecting chips. The predetermined orientation corresponds to an alignment of the each fluid ejecting chip of the second set of fluid ejecting chips at an angle of about 180 degrees)(°) with respect to each fluid ejecting chip of the two consecutive fluid ejecting chips of the first set of fluid ejecting chips. In other words, the each fluid ejecting chip of the second set of fluid ejecting chips is rotated by an angle of about 180° with respect to the each fluid ejecting chip of the first set of fluid ejecting chips. Specifically, the fluid ejecting chip 550 is configured between the fluid ejecting chips 510 and 530 in the predetermined orientation that corresponds to the alignment of the fluid ejecting chip 550 at an angle of about 180° with respect to the fluid ejecting chips 510 and 530. Similarly, the fluid ejecting chip 570 may be configured between the fluid ejecting chip 530 and a consecutive fluid ejecting chip (not shown) of the first set of fluid ejecting chips in the predetermined orientation.

It may be understood that the inkjet printhead 500 is depicted to include only four fluid ejecting chips. However, the inkjet printhead 500 may include any number of fluid ejecting chips required for printing purposes.

Further, the inkjet printhead 500 includes a plurality of fluid vias. The plurality of fluid vias includes a first set of fluid vias configured within the each fluid ejecting chip of the first set of fluid ejecting chips. Specifically, the plurality of fluid vias includes fluid vias 516, 518 and 520 configured within the fluid ejecting chip 510 of the first set of fluid ejecting chips. Similarly, the plurality of fluid vias includes fluid vias 536, 538 and 540 configured within the fluid ejecting chip 530 of the first set of fluid ejecting chips. The plurality of fluid vias also includes a second set of fluid vias configured within the each fluid ejecting chip of the second set of fluid ejecting chips. Specifically, the plurality of fluid vias includes fluid vias 556, 558 and 560 configured within the fluid ejecting chip 550 of the second set of fluid ejecting chips. Similarly, the plurality of fluid vias includes fluid vias 576, 578 and 580 configured within the fluid ejecting chip 570 of the second set of fluid ejecting chips. As depicted in FIG. 5, fluid vias of the first set of fluid vias and the second set of fluid vias have the same lengths.

Further, a fluid via of the first set of fluid vias configured in proximity to the first edge of the each fluid ejecting chip of the first set of fluid ejecting chips and a fluid via of the second set of fluid vias configured in proximity to the second edge of the each fluid ejecting chip of the second set of fluid ejecting chips, are adapted to carry a fluid of a first type, such as cyan color. Specifically, the fluid via 516 configured in proximity to the first edge 512 of the fluid ejecting chip 510 and the fluid via 560 configured in proximity to the second edge 554 of the fluid ejecting chip 550 are adapted to carry the fluid of the first type. Similarly, the fluid via 536 configured in proximity to the first edge 532 of the fluid ejecting chip 530 and the fluid via 580 configured in proximity to the second edge 574 of the fluid ejecting chip 570 are adapted to carry the fluid of the first type.

Furthermore, a fluid via of the first set of fluid vias configured in proximity to the second edge of the each fluid ejecting chip of the first set of fluid ejecting chips and a fluid via of the second set of fluid vias configured in proximity to the first edge of the each fluid ejecting chip of the second set of fluid ejecting chips, are adapted to carry a fluid of a second type, such as yellow color. Specifically, the fluid via 520 configured in proximity to the second edge 514 of the fluid ejecting chip 510 and the fluid via 556 configured in proximity to the first edge 552 of the fluid ejecting chip 550 are adapted to carry the fluid of the second type. Similarly, the fluid via 540 configured in proximity to the second edge 534 of the fluid ejecting chip 530 and the fluid via 576 configured in proximity to the first edge 572 of the fluid ejecting chip 570 are adapted to carry the fluid of the second type.

Moreover, the fluid via 518 of the fluid ejecting chip 510 and the fluid via 558 of the fluid ejecting chip 550 are adapted to carry a fluid of a third type, such as magenta color. Similarly, the fluid via 538 of the fluid ejecting chip 530 and the fluid via 578 of the fluid ejecting chip 570 are adapted to carry the fluid of the third type.

In addition, the inkjet printhead includes a plurality of bond pads. The plurality of bond pads includes a first set of bond pads configured along the first edge of the each fluid ejecting chip of the first set of fluid ejecting chips for distributing power or control signals to fluid ejectors within the each fluid ejecting chip of the first set of fluid ejecting chips. Specifically, the plurality of bond pads includes bond pads 522 configured along the first edge 512 of the fluid ejecting chip 510 for distributing power or control signals to fluid ejectors (not shown) within the fluid ejecting chip 510. Similarly, the plurality of bond pads includes bond pads 542 configured along the first edge 532 of the fluid ejecting chip 530 for distributing power or control signals to fluid ejectors (not shown) within the fluid ejecting chip 530. Further, the first set of bond pads are capable of distributing power or control signals to the fluid ejectors within the each fluid ejecting chip of the first set of fluid ejecting chips through a first set of wires (not shown).

The plurality of bond pads further includes a second set of bond pads configured along the first edge of the each fluid ejecting chip of the second set of fluid ejecting chips for distributing power or control signals to fluid ejectors within the each fluid ejecting chip of the second set of fluid ejecting chips. Specifically, the plurality of bond pads includes bond pads 562 configured along the first edge 552 of the fluid ejecting chip 550 for distributing power or control signals to fluid ejectors (not shown) within the fluid ejecting chip 550. Similarly, the plurality of bond pads includes bond pads 582 configured along the first edge 572 of the fluid ejecting chip 570 for distributing power or control signals to fluid ejectors (not shown) within the fluid ejecting chip 570. Further, the second set of bond pads are capable of distributing power or control signals to the fluid ejectors within the each fluid ejecting chip of the second set of fluid ejecting chips through a second set of wires, such as a plurality of wires 564, as shown in FIG. 6. The inkjet printhead 500 also includes an encapsulant fabricated over the first set of bond pads and the second set of bond pads, in the form of a layer 506, as depicted in FIGS. 5 and 6.

The aforementioned arrangement of the fluid ejecting chips 510, 530, 550 and 570 and the plurality of bond pads, as depicted in FIG. 5, assists in counteracting the fluid ejecting chip tiling problem. Specifically, the plurality of bond pads, such as the bond pads 522, 542, 562, and 582, are placed on the respective first edges 512, 532, 552 and 572 of the fluid ejecting chips 510, 530, 550 and 570 that are positioned in alternate orientations (i.e., rotated by an angle of about 180° with respect to each other) to form an array along a direction of a print media's length (such as length of a paper). Further, distance between a fluid via (such as the fluid via 516) of a fluid ejecting chip of the first row 502 (such as the fluid ejecting chip 510) and a fluid via (such as the fluid via 560) of a consecutive fluid ejecting chip of the second row 504 (such as the fluid ejecting chip 550) that carry the fluid of the same type/color, is minimized by way of such an arrangement. Further, such a distance (as depicted by a distance 'D6') is independent of encapsulant footprint tolerance.

By way of such an aforementioned arrangement of the inkjet printhead 500, power/control signals distribution may be routed within the plurality of fluid ejecting chips of the inkjet by modifying dimension/size of each fluid ejecting chip of the inkjet printhead 500. For example, FIG. 6 depicts the fluid ejecting chip 550 that includes the bond pads 562 along the first edge 552 thereof, and is fabricated to have a length more than that of a conventional fluid ejecting chip, such as the fluid ejecting chip 100 of FIG. 1, which have bond pads configured along respective breadths/shorter sides thereof, in order to route the power/control signals distribution through the bond pads 562 that are configured along the first edge 552, i.e., longitudinal edge, of the fluid ejecting chip 550. It is to be understood that other fluid ejecting chips, such as the fluid ejecting chips 510, 530 and 570, of the inkjet printhead 500 also have been fabricated to have a length more than the conventional fluid ejecting chips that have bond pads configured along respective breadths/shorter sides thereof.

Alternatively, manufacturing of an inkjet printhead may involve fabrication of fluid ejecting chips, such as a fluid ejecting chip 600 of FIG. 7 that is wider than a conventional fluid ejecting chip, such as the fluid ejecting chip 100 of FIG. 1 and the fluid ejecting chips of FIG. 5. Such a wide fluid ejecting chip may also assist in routing power or control signals distribution appropriately within the fluid ejecting chip 600 that includes a plurality of bond pads 602 and a plurality of wires 604. As depicted in FIG. 7, the bond pads 602 are configured along a first edge 606, i.e., longitudinal edge, of the fluid ejecting chip 600.

With regard to cost incur, FIG. 8 depicts a graph 800 that illustrates a comparison of print swath die cost for fluid ejecting chips (yielding 1 inch (") print swath) with varying length and fluid ejecting chips (yielding 1" print swath) with varying width for inkjet printheads. Specifically, the graph 800 depicts a curve 802 that is a fluid ejecting chip cost curve for varying lengths when fluid ejecting chip's width is held constant. Further, the graph 800 depicts a curve 804 that is a fluid ejecting chip cost curve for varying widths when the fluid ejecting chip's length is held constant. It may be observed that increasing the length of a 1 inch" print swath fluid ejecting chip is costlier than increasing the width thereof.

Also, it has been observed that a large number of fluid ejecting chips, such as the fluid ejecting chips 510, 530, 550, and 570; and 600, may be required to be employed in an array to obtain longer print swaths. As a result, fabrication of inkjet printheads employing multiplicity of such fluid ejecting chips may be associated with high cost incur.

Accordingly, there still persists a need for an efficient and cost-effective inkjet printhead that includes fluid ejecting chips, fluid vias and bond pads, arranged in a manner that facilitates in obtaining a long print swath while eliminating skew effects on print quality and encapsulant footprint tolerances, and in optimizing power/control signals distribution within the fluid ejecting chips.

SUMMARY OF THE DISCLOSURE

In view of the foregoing disadvantages inherent in the prior art, the general purpose of the present disclosure is to provide an inkjet printhead, by including all the advantages of the prior art, and overcoming the drawbacks inherent therein.

In one aspect, the present disclosure provides an inkjet printhead that includes a plurality of fluid ejecting chips arranged in a plurality of rows. The plurality of fluid ejecting chips includes a first set of fluid ejecting chips arranged in a first row of the plurality of rows. Each fluid ejecting chip of the first set of fluid ejecting chips includes a first edge and a second edge opposite to the first edge. The plurality of fluid ejecting chips also includes a second set of fluid ejecting chips arranged in a second row of the plurality of rows. The second row is parallel to the first row. Each fluid ejecting chip of the second set of fluid ejecting chips includes a first edge and a second edge opposite to the first edge. Further, the each fluid ejecting chip of the second set of fluid ejecting chips is configured between two consecutive fluid ejecting chips of the first set of fluid ejecting chips in a predetermined orientation such that the second edge of the each fluid ejecting chip of the second set of fluid ejecting chips is in proximity to a respective second edge of a fluid ejecting chip of the two consecutive fluid ejecting chips preceding the each fluid ejecting chip of the second set of fluid ejecting chips.

The inkjet printhead further includes a plurality of fluid vias that includes a first set of fluid vias configured in a stepwise manner within the each fluid ejecting chip of the first set of fluid ejecting chips, and a second set of fluid vias configured in a stepwise manner within the each fluid ejecting chip of the second set of fluid ejecting chips. Furthermore, the inkjet printhead includes a plurality of bond pads. The plurality of bond pads includes a first set of bond pads configured along at least one of the first edge and the second edge of the each fluid ejecting chip of the first set of fluid ejecting chips for distributing at least one of power and control signals to fluid ejectors within the each fluid ejecting chip of the first set of fluid ejecting chips. The plurality of bond pads further includes a second set of bond pads configured along at least one of the first edge and the second edge of the each fluid ejecting chip of the second set of fluid ejecting chips for distributing at least one of power and control signals to fluid ejectors within the each fluid ejecting chip of the second set of fluid ejecting chips.

In another aspect, the present disclosure provides an inkjet printhead that includes a plurality of fluid ejecting chips arranged in a plurality of rows. The plurality of fluid ejecting chips includes a first set of fluid ejecting chips arranged in a first row of the plurality of rows. Further, the plurality of fluid ejecting chips includes a second set of fluid ejecting chips arranged in a second row of the plurality of rows. The second row is parallel to the first row. Each fluid ejecting chip of the second set of fluid ejecting chips is configured between two consecutive fluid ejecting chips of the first set of fluid ejecting chips in a predetermined orientation. The inkjet printhead also includes a plurality of fluid vias. The plurality of fluid vias includes a first set of fluid vias of varying lengths configured within each fluid ejecting chip of the first set of fluid ejecting chips. Respective fluid vias of the two consecutive fluid ejecting chips of the first set of fluid ejecting chips carrying a fluid of the same type have the same length. Further, the plurality of fluid vias includes a second set of fluid vias of varying lengths configured within the each fluid ejecting chip of the second set of fluid ejecting chips. Respective fluid vias of consecutive fluid ejecting chips of the second set of fluid ejecting chips carrying a fluid of the same type have the same length.

In yet another aspect, the present disclosure provides a fluid ejecting chip that includes a plurality of fluid vias of varying lengths configured within the fluid ejecting chip. The fluid ejecting chip also includes a plurality of bond pads configured along an edge of the fluid ejecting chip for distributing at least one of power and control signals to fluid ejectors within the fluid ejecting chip. Further, the plurality of bond pads is configured adjacent to a shortest fluid via of the plurality of fluid vias of varying lengths.

In still another aspect, the present disclosure provides a fluid ejecting chip that includes a plurality of fluid vias configured within the fluid ejecting chip. The fluid ejecting chip also includes a plurality of bond pads configured along an edge of the fluid ejecting chip for distributing at least one of power and control signals to fluid ejectors within the fluid ejecting chip. Further, the plurality of bond pads is configured adjacent to a periphery of the fluid ejecting chip.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

Figure 1:
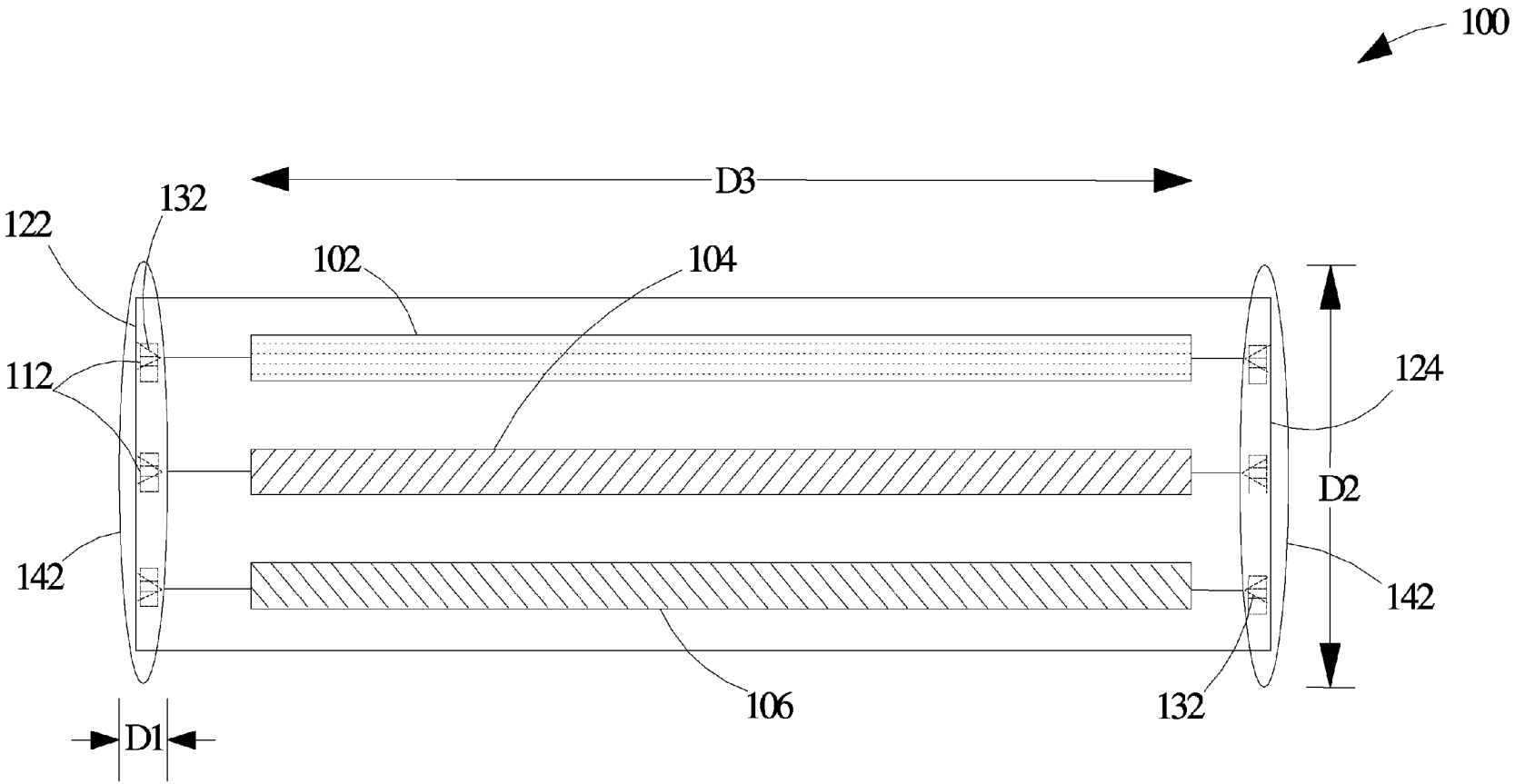
FIG. 1 depicts a prior art fluid ejecting chip for an inkjet printhead.
Figure 2:
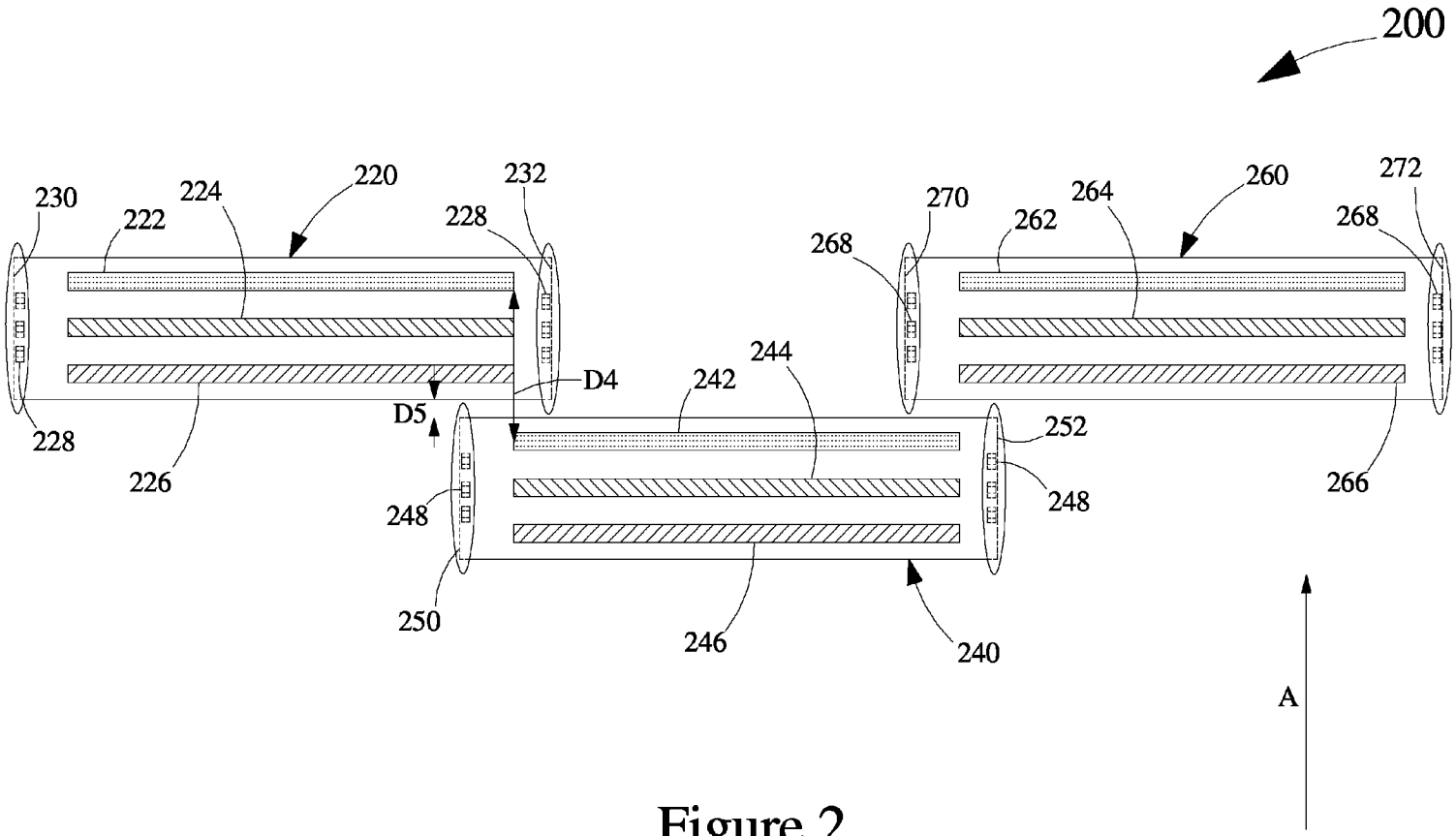
FIG. 2 is a schematic depiction of a prior art inkjet printhead.
Figure 3:
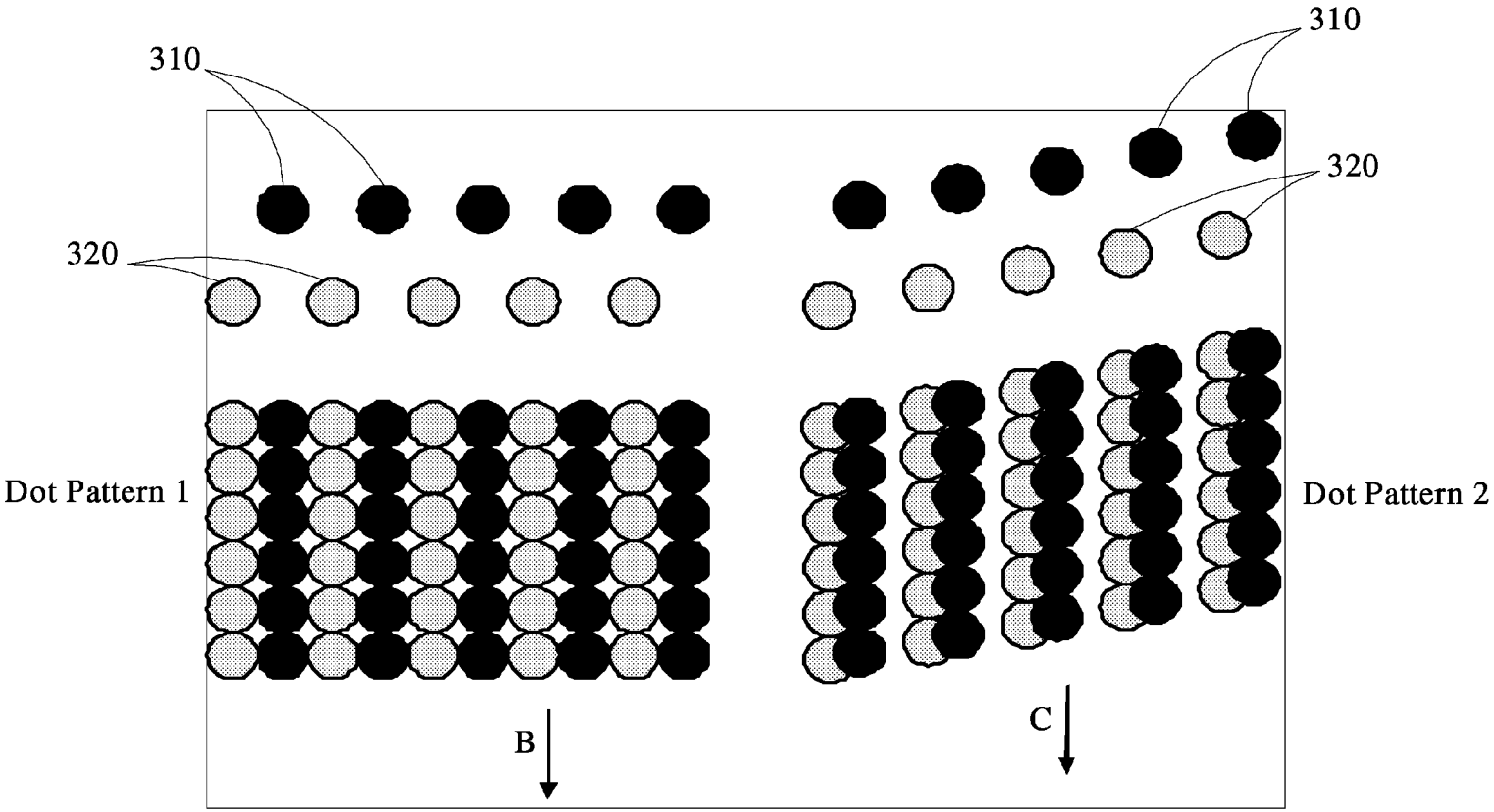
FIG. 3 depicts dot patterns to illustrate effects of paper skew on print quality.
Figure 4:
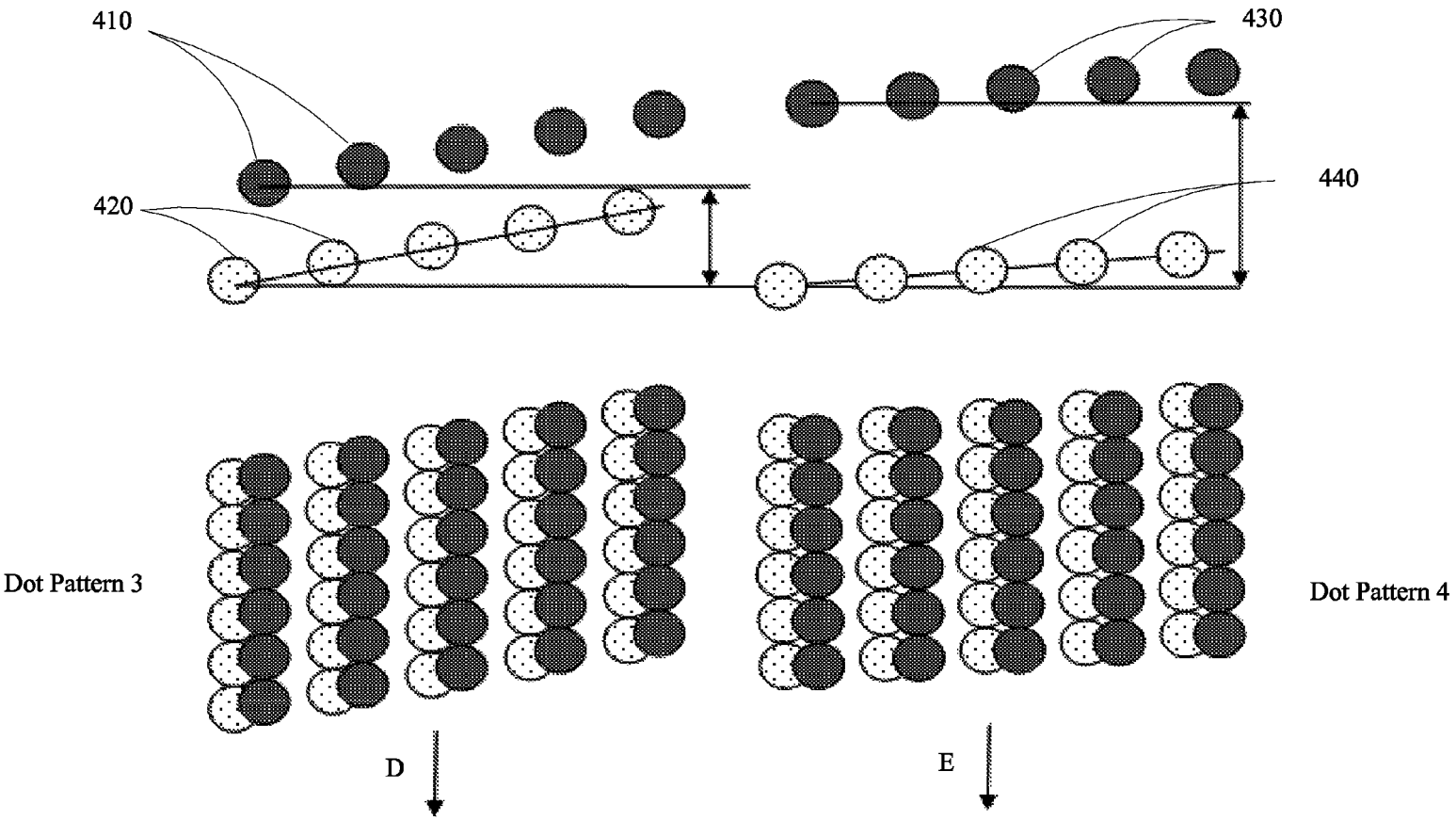
FIG. 4 depicts dot patterns to illustrate the relation between nozzle distance and skew effects on drop location and print quality.

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides an inkjet printhead that includes a plurality of fluid ejecting chips arranged in a plurality of rows. The plurality of fluid ejecting chips includes a first set of fluid ejecting chips arranged in a first row of the plurality of rows. Each fluid ejecting chip of the first set of fluid ejecting chips includes a first edge and a second edge opposite to the first edge. Further, the plurality of fluid ejecting chips includes a second set of fluid ejecting chips arranged in a second row of the plurality of rows. The second row is parallel to the first row. Each fluid ejecting chip of the second set of fluid ejecting chips includes a first edge and a second edge opposite to the first edge. Further, the each fluid ejecting chip of the second set of fluid ejecting chips is configured between two consecutive fluid ejecting chips of the first set of fluid ejecting chips in a predetermined orientation such that the second edge of the each fluid ejecting chip of the second set of fluid ejecting chips is in proximity to a respective second edge of a fluid ejecting chip of the two consecutive fluid ejecting chips preceding the each fluid ejecting chip of the second set of fluid ejecting chips.

The inkjet printhead further includes a plurality of fluid vias that includes a first set of fluid vias configured in a stepwise manner within the each fluid ejecting chip of the first set of fluid ejecting chips, and a second set of fluid vias configured in a stepwise manner within the each fluid ejecting chip of the second set of fluid ejecting chips. Furthermore, the inkjet printhead includes a plurality of bond pads. The plurality of bond pads includes a first set of bond pads configured along at least one of the first edge and the second edge of the each fluid ejecting chip of the first set of fluid ejecting chips for distributing at least one of power and control signals within the each fluid ejecting chip of the first set of fluid ejecting chips. The plurality of bond pads further includes a second set of bond pads configured along at least one of the first edge and the second edge of the each fluid ejecting chip of the second set of fluid ejecting chips for distributing at least one of power and control signals within the each fluid ejecting chip of the second set of fluid ejecting chips. Various embodiments of the inkjet printhead of the present disclosure are explained in conjunction with FIGS. 9-13.

Figure 9:
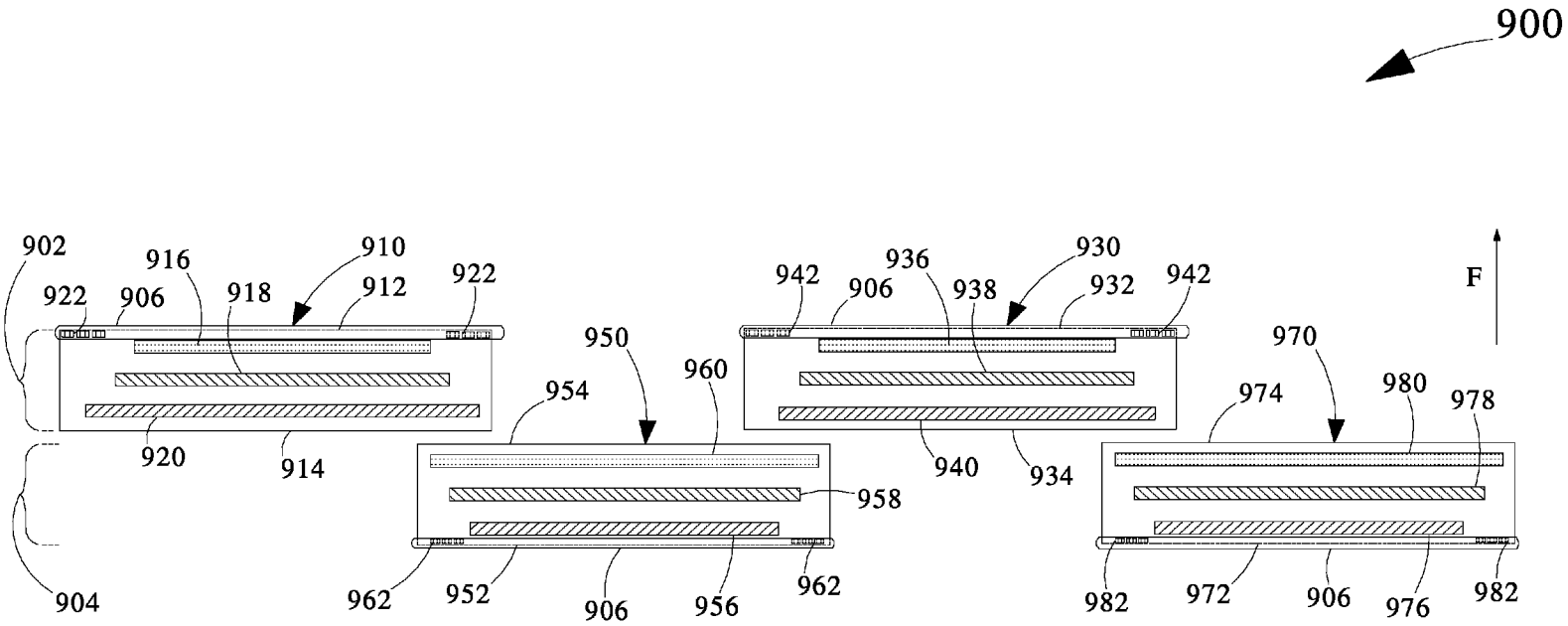
FIG. 9 is a schematic depiction of an inkjet printhead, in accordance with an embodiment of the present disclosure.

FIG. 9 is a schematic depiction of an inkjet printhead 900, in accordance with an embodiment of the present disclosure. The inkjet printhead 900 includes a plurality of fluid ejecting chips arranged in a plurality of rows, such as a first row 902 and a second row 904. Each fluid ejecting chip of the plurality of fluid ejecting chips includes a first set of fluid ejecting chips, such as fluid ejecting chips 910 and 930, arranged in the first row 902 of the plurality of rows. Each fluid ejecting chip of the first set of fluid ejecting chips includes a first edge and a second edge opposite to the first edge. Specifically, the fluid ejecting chip 910 includes a first edge 912 and a second edge 914 opposite to the first edge 912. Similarly, the fluid ejecting chip 930 includes a first edge 932 and a second edge 934 opposite to the first edge 932. Further, the first edge and the second edge of the each fluid ejecting chip of the first set of fluid ejecting chips are longitudinal straight edges.

The plurality of fluid ejecting chips also includes a second set of fluid ejecting chips, such as fluid ejecting chips 950 and 970, arranged in the second row 904 of the plurality of rows. As depicted in FIG. 9, the second row 904 is parallel to the first row 902. Each fluid ejecting chip of the second set of fluid ejecting chips includes a first edge and a second edge opposite to the first edge. Specifically, the fluid ejecting chip 950 includes a first edge 952 and a second edge 954 opposite to the first edge 952. Similarly, the fluid ejecting chip 970 includes a first edge 972 and a second edge 974 opposite to the first edge 972. Further, the first edge and the second edge of the each fluid ejecting chip of the second set of fluid ejecting chips are longitudinal straight edges.

The each fluid ejecting chip of the second set of fluid ejecting chips is configured between two consecutive fluid ejecting chips of the first set of fluid ejecting chips in a predetermined orientation such that the second edge of the each fluid ejecting chip of the second set of fluid ejecting chips is in proximity to a respective second edge of a fluid ejecting chip of the two consecutive fluid ejecting chips preceding the each fluid ejecting chip of the second set of fluid ejecting chips. The predetermined orientation corresponds to an alignment of the each fluid ejecting chip of the second set of fluid ejecting chips at an angle of about 180 degrees (°) with respect to each fluid ejecting chip of the two consecutive fluid ejecting chips of the first set of fluid ejecting chips. In other words, the each fluid ejecting chip of the second set of fluid ejecting chips is rotated by an angle of about 180° with respect to the each fluid ejecting chip of the first set of fluid ejecting chips. Specifically, the fluid ejecting chip 950 is configured between the fluid ejecting chips 910 and 930 in the predetermined orientation that corresponds to the alignment of the fluid ejecting chip 950 at an angle of about 180° with respect to the fluid ejecting chips 910 and 930. Similarly, the fluid ejecting chip 970 may be configured between the fluid ejecting chip 930 and a consecutive fluid ejecting chip (not shown) of the first set of fluid ejecting chips in the predetermined orientation.

It may be understood that the inkjet printhead 900 is depicted to include only four fluid ejecting chips. However, the inkjet printhead 900 may include any number of fluid ejecting chips required for obtaining a long print swath.

Further, the inkjet printhead 900 includes a plurality of fluid vias. The plurality of fluid vias includes a first set of fluid vias configured in a stepwise manner within the each fluid ejecting chip of the first set of fluid ejecting chips. Specifically, the plurality of fluid vias includes fluid vias 916, 918 and 920 configured in the stepwise manner within the fluid ejecting chip 910 of the first set of fluid ejecting chips. Similarly, the plurality of fluid vias includes fluid vias 936, 938 and 940 configured in the stepwise manner within the fluid ejecting chip 930 of the first set of fluid ejecting chips. More specifically, the fluid vias 916, 918 and 920; and the fluid vias 936, 938 and 940 are configured to have varying lengths. Further, shortest fluid vias (such as the fluid vias 916 and 936) of the fluid vias of varying lengths are configured in proximity to the respective first edges (such as the first edges 912 and 932) of the each fluid ejecting chip (such as the fluid ejecting chips 910 and 930) of the first set of fluid ejecting chips.

The plurality of fluid vias also includes a second set of fluid vias configured in a stepwise manner within the each fluid ejecting chip of the second set of fluid ejecting chips. Specifically, the plurality of fluid vias includes fluid vias 956, 958 and 960 configured in a stepwise manner within the fluid ejecting chip 950 of the second set of fluid ejecting chips. Similarly, the plurality of fluid vias includes fluid vias 976, 978 and 980 configured in a stepwise manner within the fluid ejecting chip 970 of the second set of fluid ejecting chips. More specifically, the fluid vias 956, 958 and 960; and the fluid vias 976, 978 and 980 are configured to have varying lengths. Further, shortest fluid vias (such as the fluid vias 956 and 976) of the fluid vias of varying lengths are configured in proximity to the respective first edges (such as the first edges 952 and 972) of the each fluid ejecting chip (such as the fluid ejecting chips 950 and 970) of the second set of fluid ejecting chips.

As depicted in FIG. 9, a fluid via of the first set of fluid vias configured in proximity to the first edge of the each fluid ejecting chip of the first set of fluid ejecting chips and a fluid via of the second set of fluid vias configured in proximity to the second edge of the each fluid ejecting chip of the second set of fluid ejecting chips, are adapted to carry a fluid of a first type, such as cyan color. Specifically, the fluid via 916 configured in proximity to the first edge 912 of the fluid ejecting chip 910 and the fluid via 960 configured in proximity to the second edge 954 of the fluid ejecting chip 950 are adapted to carry the fluid of the first type. Similarly, the fluid via 936 configured in proximity to the first edge 932 of the fluid ejecting chip 930 and the fluid via 980 configured in proximity to the second edge 974 of the fluid ejecting chip 970 are adapted to carry the fluid of the first type.

Further, a fluid via of the first set of fluid vias configured in proximity to the second edge of the each fluid ejecting chip of the first set of fluid ejecting chips and a fluid via of the second set of fluid vias configured in proximity to the first edge of the each fluid ejecting chip of the second set of fluid ejecting chips, are adapted to carry a fluid of a second type, such as yellow color. Specifically, the fluid via 920 configured in proximity to the second edge 914 of the fluid ejecting chip 910 and the fluid via 956 configured in proximity to the first edge 952 of the fluid ejecting chip 950 are adapted to carry the fluid of the second type. Similarly, the fluid via 940 configured in proximity to the second edge 934 of the fluid ejecting chip 930 and the fluid via 976 configured in proximity to the first edge 972 of the fluid ejecting chip 970 are adapted to carry the fluid of the second type.

Furthermore, the fluid via 918 of the fluid ejecting chip 910 and the fluid via 958 of the fluid ejecting chip 950 are adapted to carry a fluid of a third type, such as magenta color. Similarly, the fluid via 938 of the fluid ejecting chip 930 and the fluid via 978 of the fluid ejecting chip 970 are adapted to carry the fluid of the third type.

Accordingly, order of fluids of different types switches in a rotated fluid ejecting chip (such as the fluid ejecting chip 950 and 970) configured adjacent to the fluid ejecting chips 910 and 930, respectively. Such an arrangement of the plurality of fluid ejecting chips continues along the plurality of rows of the inkjet printhead 900.

In addition, the inkjet printhead includes a plurality of bond pads. The plurality of bond pads includes a first set of bond pads configured along the first edge, and in proximity to respective shortest fluid vias of the first set of fluid vias, of the each fluid ejecting chip of the first set of fluid ejecting chips for distributing at least one of power and control signals to fluid ejectors within the each fluid ejecting chip of the first set of fluid ejecting chips. Specifically, the plurality of bond pads includes bond pads 922 configured along the first edge 912 and in proximity to the fluid via 916 of the fluid ejecting chip 910 for distributing at least one of power and control signals to fluid ejectors (not shown) within the fluid ejecting chip 910. Similarly, the plurality of bond pads includes bond pads 942 configured along the first edge 932 and in proximity to the fluid via 936 of the fluid ejecting chip 930 for distributing at least one of power and control signals to fluid ejectors (not shown) within the fluid ejecting chip 930. Further, the first set of bond pads are capable of distributing the at least one of power and control signals to the fluid ejectors within the each fluid ejecting chip of the first set of fluid ejecting chips through a first set of wires (not shown).

The plurality of bond pads further includes a second set of bond pads configured along the first edge, and in proximity to a respective shortest fluid via of the second set of fluid vias, of the each fluid ejecting chip of the second set of fluid ejecting chips for distributing at least one of power and control signals to fluid ejectors (not shown) within the each fluid ejecting chip of the second set of fluid ejecting chips. Specifically, the plurality of bond pads includes bond pads 962 configured along the first edge 952 and in proximity to the fluid via 956 of the fluid ejecting chip 950 for distributing at least one of power and control signals to fluid ejectors (not shown) within the fluid ejecting chip 950. Similarly, the plurality of bond pads includes bond pads 982 configured along the first edge 972 and in proximity to the fluid via 976 of the fluid ejecting chip 970 for distributing at least one of power and control signals to fluid ejectors (not shown) within the fluid ejecting chip 970. Further, the second set of bond pads are capable of distributing the at least one of power and control signals to the fluid ejectors within the each fluid ejecting chip of the second set of fluid ejecting chips through a second set of wires, such as a plurality of wires 964, as shown in FIG. 10.

Figure 10:
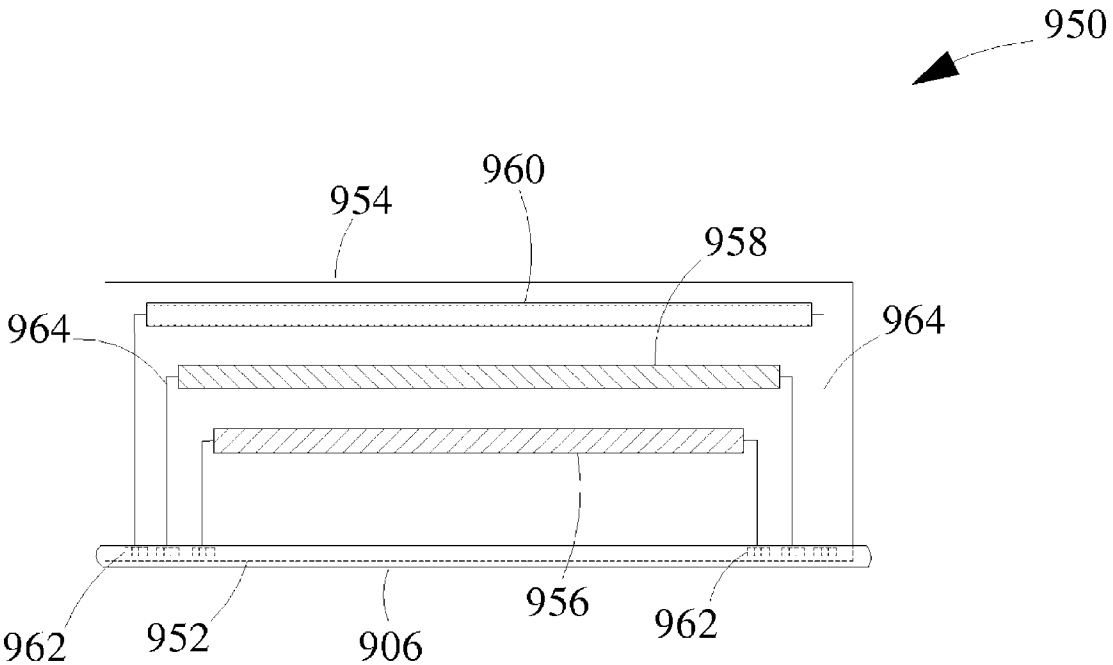
FIG. 10 depicts a fluid ejecting chip of the inkjet printhead of FIG. 9.

Referring to FIGS. 9 and 10, the inkjet printhead 900 also includes an encapsulant fabricated over the first set of bond pads, such as the bond pads 922, 942, 462 and 982, in the form of a layer 906.

As depicted in FIG. 9, the aforementioned arrangement of the fluid ejecting chips 910, 930, 950 and 970 and the plurality of bond pads assists in counteracting the prior art fluid ejecting chip tiling problem. Specifically, the plurality of bond pads, such as the bond pads 922, 942, 962, and 982, are placed on the respective first edges 912, 932, 952 and 972 of the fluid ejecting chips 910, 930, 950 and 970 that are positioned in alternate orientations (i.e., rotated by an angle of about 180° with respect to each other) to form an array along a direction 'F' of a print medium's length (such as length of a paper). Further, distance between a fluid via (such as the fluid via 916) of a fluid ejecting chip of the first row 902 (such as the fluid ejecting chip 910) and a fluid via (such as the fluid via 960) of a consecutive fluid ejecting chip of the second row 904 (such as the fluid ejecting chip 950) that carry a fluid of the same type, is minimized by way of such an arrangement. Furthermore, such a distance is independent of encapsulant footprint tolerance.

In addition, as shown in FIG. 9, the inkjet printhead 900 includes stepped fluid vias, and accordingly, may have stepped nozzle arrays (not shown) in order to be configured as a wide swath inkjet printhead formed from multiple color fluid ejecting chips (such as the fluid ejecting chips 910, 930, 950 and 970) that are closely fabricated/tiled to minimize distance between fluid vias of consecutive fluid ejecting chips carrying the same fluid type/color, and to reduce negative effects of paper skew on print quality. Also, by such an arrangement, power or control signals distribution routing of the fluid ejecting chip may occur appropriately without the need of segmented fluid vias. As an example, FIG. 10 depicts the power/control signals distribution routing within the fluid ejecting chip 950. As shown in FIG. 10, the fluid ejecting chip 950 that includes the bond pads 962 along the first edge 952 thereof, in order to appropriately route the power/control signals distribution through the bond pads 962 that are configured along the first edge 952, i.e., longitudinal edge, of the fluid ejecting chip 950. It is to be understood that other fluid ejecting chips, such as the fluid ejecting chips 910, 930 and 970, of the inkjet printhead 900 also may be fabricated to have a length more than the conventional fluid ejecting chips that have bond pads configured along respective breadths/shorter sides thereof.

Figure 5:
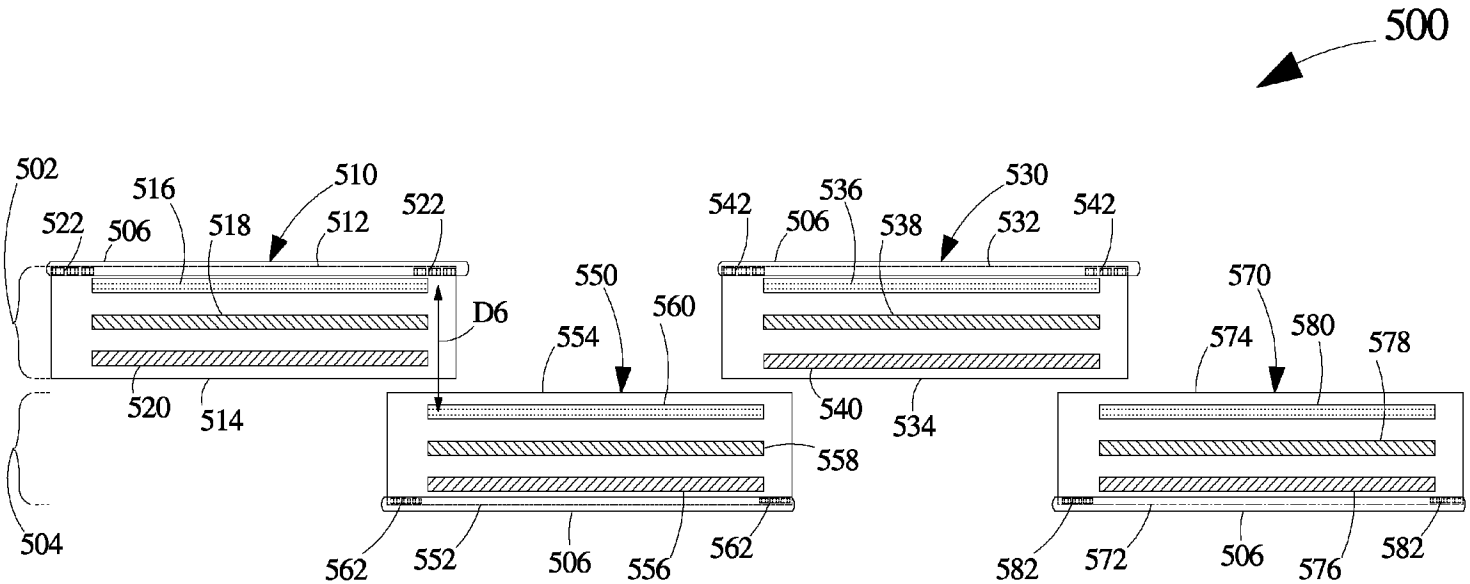
FIG. 5 is a schematic depiction of an alternate design for an inkjet printhead.
Figure 6:
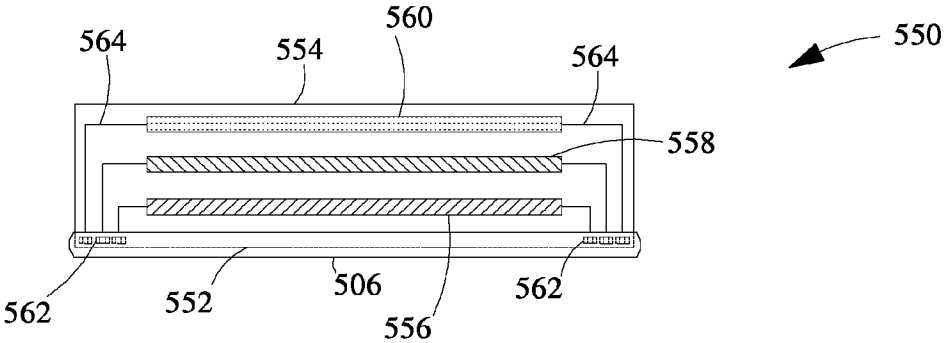
FIG. 6 depicts a fluid ejecting chip of the inkjet printhead of FIG. 5.
Figure 7:
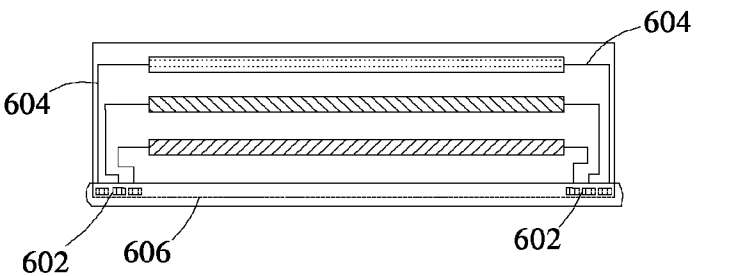
FIG. 7 depicts an alternate design of a fluid ejecting chip for an inkjet printhead.
Figure 8:
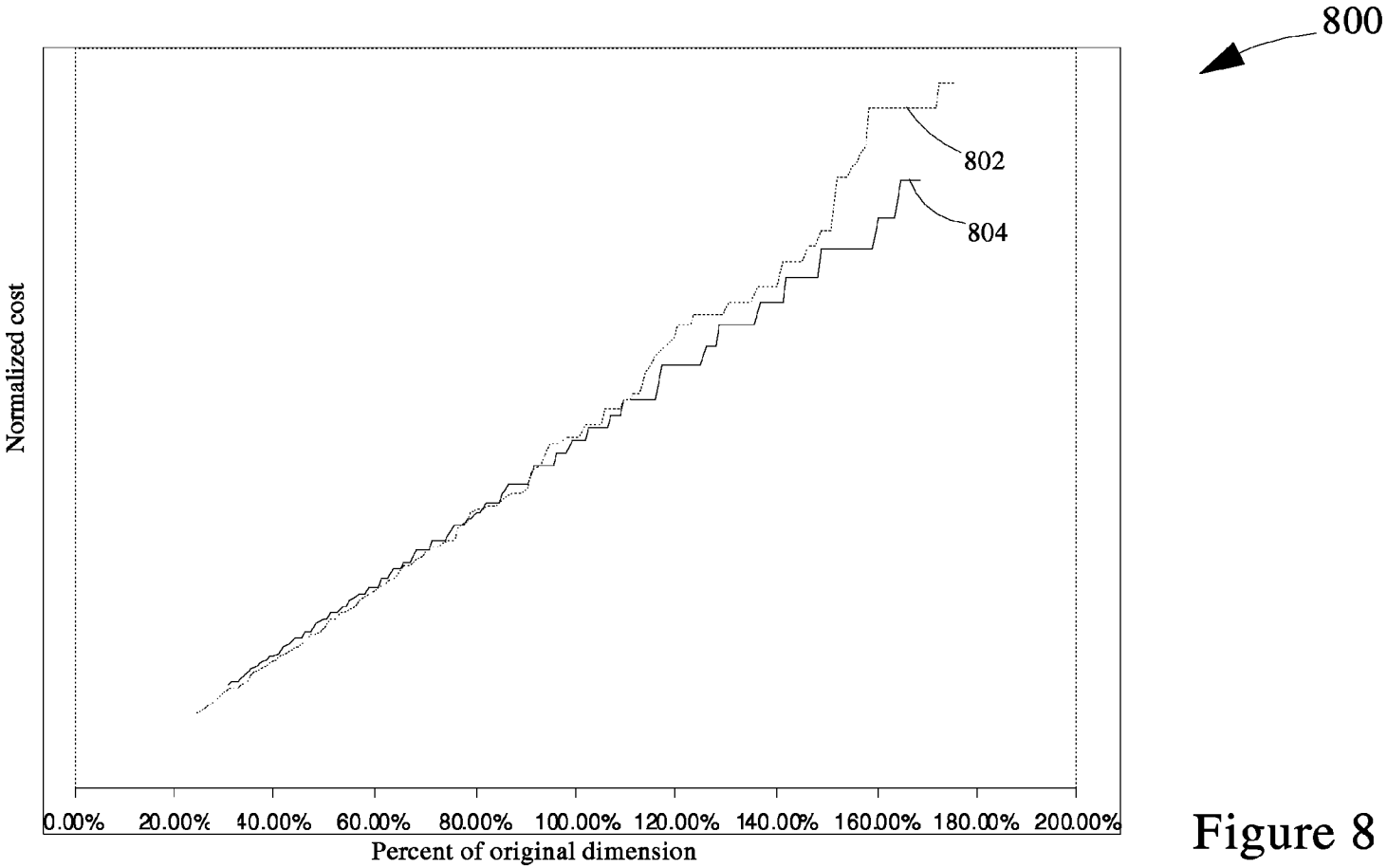
FIG. 8 depicts a graph illustrating a comparison of print swath die cost for fluid ejecting chips with varying length and fluid ejecting chips with varying width.
Figure 11:
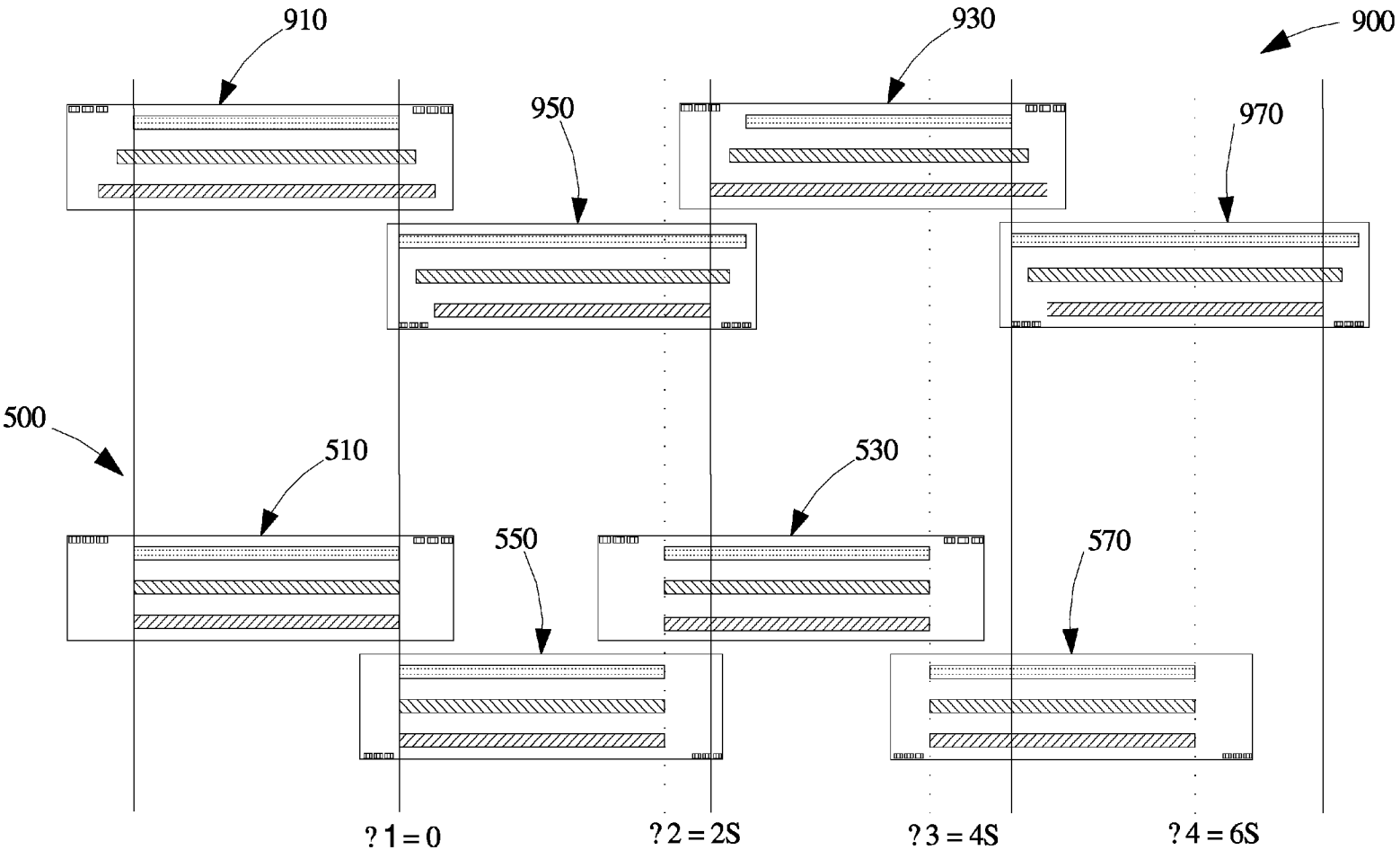
FIG. 11 depicts a comparison of print swaths obtained by the inkjet printhead of FIG. 9 and by the inkjet printhead of FIG. 5.

FIG. 11 depicts a comparison of print swaths obtained by the inkjet printhead 900 of FIG. 9 and by the inkjet printhead 500 of FIG. 5. Specifically, FIG. 11 depicts the manner in which longer print swaths may be achieved using the inkjet printhead 900 that includes the fluid ejecting chips 910, 930, 950 and 970, which have lengths equal to the fluid ejecting chips 510, 530, 550 and 590 of the inkjet printhead 500. As depicted in FIG. 11, 'Δ' represents a difference in terms of 'S' that may be defined either as step depth or as length increment between respective fluid vias of the inkjet printhead 900 and the respective fluid vias of the inkjet printhead 500. For the sake of depiction, the inkjet printheads 900 and 500 are shown without any encapsulant.

Based on the foregoing, longer print swaths may be achieved with a stepped fluid via design having the fluid ejecting chip length equal to that of the fluid ejecting chip with uniformly long fluid vias. As a result, arrangement of the fluid vias in a stepwise manner assists in reducing the number of fluid ejecting chips required to make a wide swath inkjet printhead, and therefore, assists in reducing costs incurred for fabricating the wide swath inkjet printhead.

Figure 12:
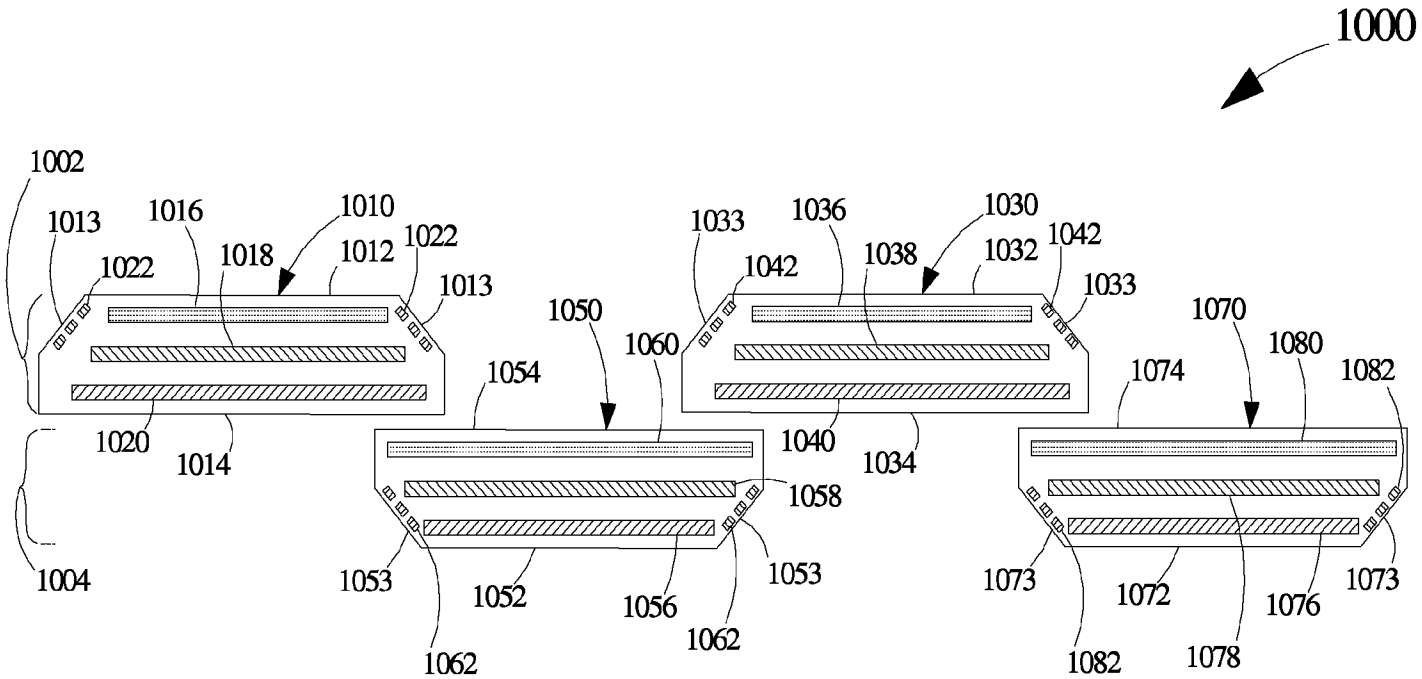
FIG. 12 is a schematic depiction of an inkjet printhead, in accordance with another embodiment of the present disclosure.

FIG. 12 is a schematic depiction of an inkjet printhead 1000, in accordance with yet another embodiment of the present disclosure. The inkjet printhead 1000 is similar to the inkjet printhead 900 and includes a plurality of fluid ejecting chips arranged in a plurality of rows, such as a first row 1002 and a second row 1004. Each fluid ejecting chip of the plurality of fluid ejecting chips includes a first set of fluid ejecting chips, such as fluid ejecting chips 1010 and 1030, arranged in the first row 1002 of the plurality of rows. Each fluid ejecting chip of the first set of fluid ejecting chips includes a first edge and a second edge opposite to the first edge. Specifically, the fluid ejecting chip 1010 includes a first edge 1012 and a second edge 1014 opposite to the first edge 1012. Similarly, the fluid ejecting chip 1030 includes a first edge 1032 and a second edge 1034 opposite to the first edge 1032. Further, the first edge of the each fluid ejecting chip of the first set of fluid ejecting chips has slanted end portions, and the second edge of the each fluid ejecting chip of the first set of fluid ejecting chips is a longitudinal straight edge. Specifically, the first edge 1012 of the fluid ejecting chip 1010 has slanted end portions 1013. Similarly, the first edge 1032 of the fluid ejecting chip 1030 has slanted end portions 1033.

The plurality of fluid ejecting chips also includes a second set of fluid ejecting chips, such as fluid ejecting chips 1050 and 1070, arranged in the second row 1004 of the plurality of rows. As depicted in FIG. 12, the second row 1004 is parallel to the first row 1002. Each fluid ejecting chip of the second set of fluid ejecting chips includes a first edge and a second edge opposite to the first edge. Specifically, the fluid ejecting chip 1050 includes a first edge 1052 and a second edge 1054 opposite to the first edge 1052. Similarly, the fluid ejecting chip 1070 includes a first edge 1072 and a second edge 1074 opposite to the first edge 1072. Further, the first edge of the each fluid ejecting chip of the second set of fluid ejecting chips has slanted end portions, and the second edge of the each fluid ejecting chip of the second set of fluid ejecting chips is a longitudinal straight edge. Specifically, the first edge 1052 of the fluid ejecting chip 1050 has slanted end portions 1053. Similarly, the first edge 1072 of the fluid ejecting chip 1070 has slanted end portions 1073.

The each fluid ejecting chip of the second set of fluid ejecting chips is configured between two consecutive fluid ejecting chips of the first set of fluid ejecting chips in a predetermined orientation such that the second edge of the each fluid ejecting chip of the second set of fluid ejecting chips is in proximity to a respective second edge of a fluid ejecting chip of the two consecutive fluid ejecting chips preceding the each fluid ejecting chip of the second set of fluid ejecting chips. The predetermined orientation corresponds to an alignment of the each fluid ejecting chip of the second set of fluid ejecting chips at an angle of about 180° with respect to each fluid ejecting chip of the two consecutive fluid ejecting chips of the first set of fluid ejecting chips. In other words, the each fluid ejecting chip of the second set of fluid ejecting chips is rotated by an angle of about 180° with respect to the each fluid ejecting chip of the first set of fluid ejecting chips. Specifically, the fluid ejecting chip 1050 is configured between the fluid ejecting chips 1010 and 1030 in the predetermined orientation that corresponds to the alignment of the fluid ejecting chip 1050 at an angle of about 180° with respect to the fluid ejecting chips 1010 and 1030. Similarly, the fluid ejecting chip 1070 may be configured between the fluid ejecting chip 1030 and a consecutive fluid ejecting chip (not shown) of the first set of fluid ejecting chips in the predetermined orientation.

It may be understood that the inkjet printhead 1000 is depicted to include only four fluid ejecting chips. However, the inkjet printhead 1000 may include any number of fluid ejecting chips required for obtaining a long print swath.

Further, the inkjet printhead 1000 includes a plurality of fluid vias. The plurality of fluid vias includes a first set of fluid vias configured in a stepwise manner within the each fluid ejecting chip of the first set of fluid ejecting chips. Specifically, the plurality of fluid vias includes fluid vias 1016, 1018 and 1020 configured in the stepwise manner within the fluid ejecting chip 1010 of the first set of fluid ejecting chips. Similarly, the plurality of fluid vias includes fluid vias 1036, 1038 and 1040 configured in the stepwise manner within the fluid ejecting chip 1030 of the first set of fluid ejecting chips. More specifically, the fluid vias 1016, 1018 and 1020; and the fluid vias 1036, 1038 and 1040 are configured to have varying lengths. Further, shortest fluid vias (such as the fluid vias 1016 and 1036) of the fluid vias of varying lengths are configured in proximity to the respective first edges (such as the first edges 1012 and 1032) of the each fluid ejecting chip (such as the fluid ejecting chips 1010 and 1030) of the first set of fluid ejecting chips.

The plurality of fluid vias also includes a second set of fluid vias configured in a stepwise manner within the each fluid ejecting chip of the second set of fluid ejecting chips. Specifically, the plurality of fluid vias includes fluid vias 1056, 1058 and 1060 configured in a stepwise manner within the fluid ejecting chip 1050 of the second set of fluid ejecting chips. Similarly, the plurality of fluid vias includes fluid vias 1076, 1078 and 1080 configured in a stepwise manner within the fluid ejecting chip 1070 of the second set of fluid ejecting chips. More specifically, the fluid vias 1056, 1058 and 1060; and the fluid vias 1076, 1078 and 1080 are configured to have varying lengths. Further, shortest fluid vias (such as the fluid vias 1056 and 1076) of the fluid vias of varying lengths are configured in proximity to the respective first edges (such as the first edges 1052 and 1072) of the each fluid ejecting chip (such as the fluid ejecting chips 1050 and 1070) of the second set of fluid ejecting chips.

As depicted in FIG. 12, a fluid via of the first set of fluid vias configured in proximity to the first edge of the each fluid ejecting chip of the first set of fluid ejecting chips and a fluid via of the second set of fluid vias configured in proximity to the second edge of the each fluid ejecting chip of the second set of fluid ejecting chips, are adapted to carry a fluid of a first type, such as cyan color. Specifically, the fluid via 1016 configured in proximity to the first edge 1012 of the fluid ejecting chip 1010 and the fluid via 1060 configured in proximity to the second edge 1054 of the fluid ejecting chip 1050 are adapted to carry the fluid of the first type. Similarly, the fluid via 1036 configured in proximity to the first edge 1032 of the fluid ejecting chip 1030 and the fluid via 1080 configured in proximity to the second edge 1074 of the fluid ejecting chip 1070 are adapted to carry the fluid of the first type.

Further, a fluid via of the first set of fluid vias configured in proximity to the second edge of the each fluid ejecting chip of the first set of fluid ejecting chips and a fluid via of the second set of fluid vias configured in proximity to the first edge of the each fluid ejecting chip of the second set of fluid ejecting chips, are adapted to carry a fluid of a second type, such as yellow color. Specifically, the fluid via 1020 configured in proximity to the second edge 1014 of the fluid ejecting chip 1010 and the fluid via 1056 configured in proximity to the first edge 1052 of the fluid ejecting chip 1050 are adapted to carry the fluid of the second type. Similarly, the fluid via 1040 configured in proximity to the second edge 1034 of the fluid ejecting chip 1030 and the fluid via 1076 configured in proximity to the first edge 1072 of the fluid ejecting chip 1070 are adapted to carry the fluid of the second type.

Furthermore, the fluid via 1018 of the fluid ejecting chip 1010 and the fluid via 1058 of the fluid ejecting chip 1050 are adapted to carry a fluid of a third type, such as magenta color. Similarly, the fluid via 1038 of the fluid ejecting chip 1030 and the fluid via 1078 of the fluid ejecting chip 1070 are adapted to carry the fluid of the third type.

Accordingly, order of fluids of different types switches in a rotated fluid ejecting chip (such as the fluid ejecting chip 1050 and 1070) configured adjacent to the fluid ejecting chips 1010 and 1030, respectively. Such an arrangement of the plurality of fluid ejecting chips continues along the plurality of rows of the inkjet printhead 1000.

In addition, the inkjet printhead includes a plurality of bond pads. The plurality of bond pads includes a first set of bond pads configured along the slanted end portions of the first edge, and may be in proximity to respective shortest fluid vias of the first set of fluid vias, of the each fluid ejecting chip of the first set of fluid ejecting chips for distributing at least one of power and control signals to fluid ejectors within the each fluid ejecting chip of the first set of fluid ejecting chips. Specifically, the plurality of bond pads includes bond pads 1022 configured along the slanted end portion 1013 of the first edge 1012, and may be in proximity to the fluid via 1016 of the fluid ejecting chip 1010 for distributing at least one of power and control signals to fluid ejectors (not shown) within the fluid ejecting chip 1010. Similarly, the plurality of bond pads includes bond pads 1042 configured along the slanted end portions 1033 of the first edge 1032, and may be in proximity to the fluid via 1036 of the fluid ejecting chip 1030 for distributing at least one of power and control signals to fluid ejectors (not shown) within the fluid ejecting chip 1030. Further, the first set of bond pads are capable of distributing the at least one of power and control signals to the fluid ejectors within the each fluid ejecting chip of the first set of fluid ejecting chips through a first set of wires (not shown).

The plurality of bond pads further includes a second set of bond pads configured along the slanted end portions of the first edge, and may be in proximity to a respective shortest fluid via of the second set of fluid vias, of the each fluid ejecting chip of the second set of fluid ejecting chips for distributing at least one of power and control signals to fluid ejectors within the each fluid ejecting chip of the second set of fluid ejecting chips. Specifically, the plurality of bond pads includes bond pads 1062 configured along the slanted end portions 1053 of the first edge 1052, and may be in proximity to the fluid via 1056 of the fluid ejecting chip 1050 for distributing at least one of power and control signals to fluid ejectors (not shown) within the fluid ejecting chip 1050. Similarly, the plurality of bond pads includes bond pads 1082 configured along the slanted end portions 1073 of the first edge 1072, and may be in proximity to the fluid via 1076 of the fluid ejecting chip 1070 for distributing at least one of power and control signals to fluid ejectors (not shown) within the fluid ejecting chip 1070. Further, the second set of bond pads are capable of distributing the at least one of power and control signals to the fluid ejectors within the each fluid ejecting chip of the second set of fluid ejecting chips through a second set of wires (not shown).

The inkjet printhead 1000 also includes an encapsulant fabricated over the first set of bond pads, such as the bond pads 1022, 1042, 1062 and 1082, in the form of a layer (not shown).

The arrangement of the inkjet printhead 1000 and components thereof facilitates the inkjet printhead 1000 to be considered as a wide swath inkjet printhead because of the close tiling of the fluid ejecting chips 1010, 1030, 1050 and 1070 and the stepwise arrangement of respective fluid vias thereof.

Figure 13:
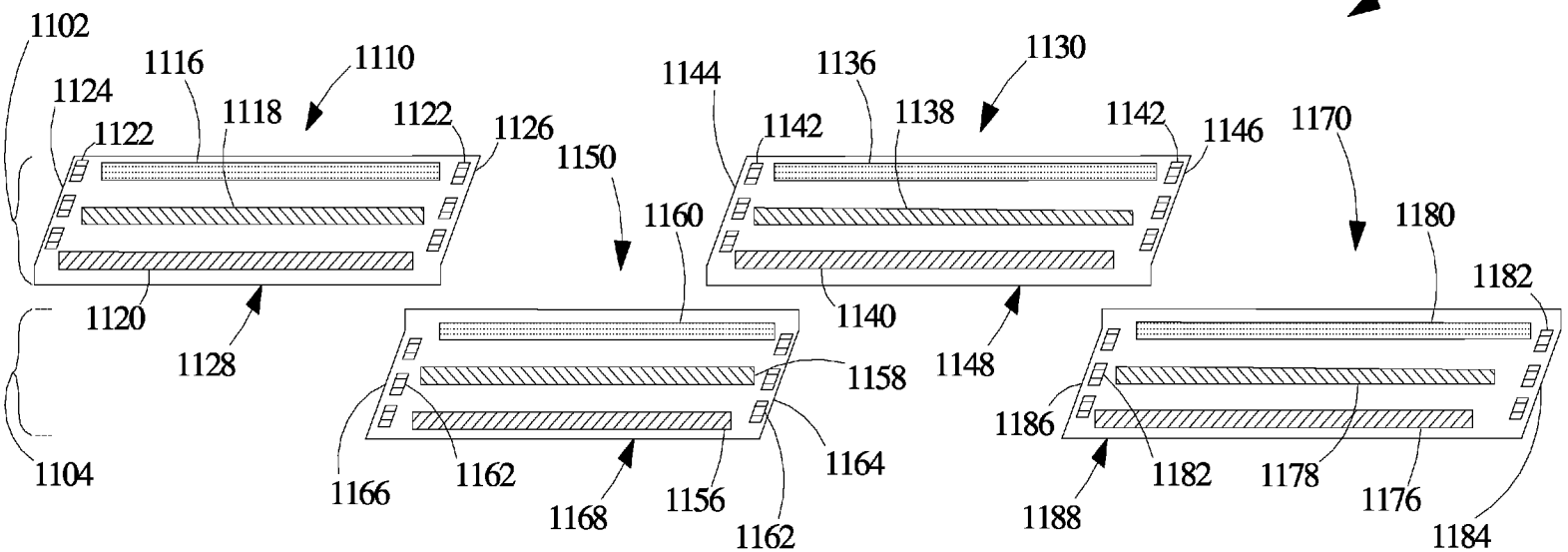
FIG. 13 is a schematic depiction of an inkjet printhead, in accordance with yet another embodiment of the present disclosure.

FIG. 13 is a schematic depiction of an inkjet printhead 1100, in accordance with still another embodiment of the present disclosure. The inkjet printhead 1100 includes a plurality of fluid ejecting chips arranged in a plurality of rows, such as a first row 1102 and a second row 1104. Each fluid ejecting chip of the plurality of fluid ejecting chips includes a first set of fluid ejecting chips, such as fluid ejecting chips 1110 and 1130, arranged in the first row 1102 of the plurality of rows. Each fluid ejecting chip of the first set of fluid ejecting chips includes a first edge and a second edge opposite to the first edge. Specifically, the fluid ejecting chip 1110 includes a first edge 1124 and a second edge 1126 opposite to the first edge 1124. Similarly, the fluid ejecting chip 1130 includes a first edge 1144 and a second edge 1146 opposite to the first edge 1144. Further, the first edge and the second edge of the each fluid ejecting chip of the first set of fluid ejecting chips are the short edges (breadths) that are skewed. Specifically, the first edge 1124 and the second edge 1126 of the fluid ejecting chip 1110 are skewed edges. Similarly, the first edge 1144 and the second edge 1146 of the fluid ejecting chip 1130 are skewed edges.

The plurality of fluid ejecting chips also includes a second set of fluid ejecting chips, such as fluid ejecting chips 1150 and 1170, arranged in the second row 1104 of the plurality of rows. As depicted in FIG. 13, the second row 1104 is parallel to the first row 1102. Each fluid ejecting chip of the second set of fluid ejecting chips includes a first edge and a second edge opposite to the first edge. Specifically, the fluid ejecting chip 1150 includes a first edge 1164 and a second edge 1166 opposite to the first edge 1164. Similarly, the fluid ejecting chip 1170 includes a first edge 1184 and a second edge 1186 opposite to the first edge 1184. Further, the first edge and the second edge of the each fluid ejecting chip of the second set of fluid ejecting chips are the short edges (breadths) that are skewed edges. Specifically, the first edge 1164 and the second edge 1166 of the fluid ejecting chip 1150 are skewed edges. Similarly, the first edge 1184 and the second edge 1186 of the fluid ejecting chip 1170 are skewed edges.

The each fluid ejecting chip of the second set of fluid ejecting chips is configured between two consecutive fluid ejecting chips of the first set of fluid ejecting chips in a predetermined orientation such that the second edge of the each fluid ejecting chip of the second set of fluid ejecting chips is in proximity to a respective second edge of a fluid ejecting chip of the two consecutive fluid ejecting chips preceding the each fluid ejecting chip of the second set of fluid ejecting chips. The predetermined orientation corresponds to an alignment of the each fluid ejecting chip of the second set of fluid ejecting chips at an angle of about 180° with respect to each fluid ejecting chip of the two consecutive fluid ejecting chips of the first set of fluid ejecting chips. In other words, the each fluid ejecting chip of the second set of fluid ejecting chips is rotated by an angle of about 180° with respect to the each fluid ejecting chip of the first set of fluid ejecting chips. Specifically, the fluid ejecting chip 1150 is configured between the fluid ejecting chips 1110 and 1130 in the predetermined orientation that corresponds to the alignment of the fluid ejecting chip 1150 at an angle of about 180° with respect to the fluid ejecting chips 1110 and 1130. Similarly, the fluid ejecting chip 1170 may be configured between the fluid ejecting chip 1130 and a consecutive fluid ejecting chip (not shown) of the first set of fluid ejecting chips in the predetermined orientation.

It may be understood that the inkjet printhead 1100 is depicted to include only four fluid ejecting chips. However, the inkjet printhead 1100 may include any number of fluid ejecting chips required for obtaining a long print swath.

Further, the inkjet printhead 1100 includes a plurality of fluid vias. The plurality of fluid vias includes a first set of fluid vias configured in a stepwise manner within the each fluid ejecting chip of the first set of fluid ejecting chips. Specifically, the plurality of fluid vias includes fluid vias 1116, 1118 and 1120 configured in the stepwise manner within the fluid ejecting chip 1110 of the first set of fluid ejecting chips. Similarly, the plurality of fluid vias includes fluid vias 1136, 1138 and 1140 configured in the stepwise manner within the fluid ejecting chip 1130 of the first set of fluid ejecting chips. However, the fluid vias 1116, 1118 and 1120; and the fluid vias 1136, 1138 and 1140 are configured to have uniform lengths.

The plurality of fluid vias also includes a second set of fluid vias configured in a stepwise manner within the each fluid ejecting chip of the second set of fluid ejecting chips. Specifically, the plurality of fluid vias includes fluid vias 1156, 1158 and 1160 configured in a stepwise manner within the fluid ejecting chip 1150 of the second set of fluid ejecting chips. Similarly, the plurality of fluid vias includes fluid vias 1176, 1178 and 1180 configured in a stepwise manner within the fluid ejecting chip 1170 of the second set of fluid ejecting chips. However, the fluid vias 1156, 1158 and 1160; and the fluid vias 1176, 1178 and 1180 are configured to have uniform lengths.

As depicted in FIG. 13, the fluid via 1116 of the fluid ejecting chip 1110 and the fluid via 1160 of the fluid ejecting chip 1110 are adapted to carry a fluid of a first type, such as cyan color. Similarly, the fluid via 1136 of the fluid ejecting chip 1130 and the fluid via 1180 of the fluid ejecting chip 1170 are adapted to carry the fluid of the first type.

Further, the fluid via 1120 of the fluid ejecting chip 1110 and the fluid via 1156 of the fluid ejecting chip 1150 are adapted to carry a first of a second type, such as yellow color. Similarly, the fluid via 1140 of the fluid ejecting chip 1130 and the fluid via 1176 of the fluid ejecting chip 1170 are adapted to carry the fluid of the second type.

Furthermore, the fluid via 1118 of the fluid ejecting chip 1110 and the fluid via 1158 of the fluid ejecting chip 1150 are adapted to carry a fluid of a third type, such as magenta color. Similarly, the fluid via 1138 of the fluid ejecting chip 1130 and the fluid via 1178 of the fluid ejecting chip 1170 are adapted to carry the fluid of the third type.

In addition, the inkjet printhead includes a plurality of bond pads. The plurality of bond pads includes a first set of bond pads configured along the first edge and the second edge of the each fluid ejecting chip of the first set of fluid ejecting chips for distributing at least one of power and control signals to fluid ejectors within the each fluid ejecting chip of the first set of fluid ejecting chips. Specifically, the plurality of bond pads includes bond pads 1122 configured along the first edge 1124 and the second edge 1126 of the fluid ejecting chip 1110 for distributing at least one of power and control signals to fluid ejectors (not shown) within the fluid ejecting chip 1110. Similarly, the plurality of bond pads includes bond pads 1142 configured along the first edge 1144 and the second edge 1146 of the fluid ejecting chip 1130 for distributing at least one of power and control signals to fluid ejectors (not shown) within the fluid ejecting chip 1130. Further, the first set of bond pads are capable of distributing the at least one of power and control signals to the fluid ejectors within the each fluid ejecting chip of the first set of fluid ejecting chips through a first set of wires (not numbered).

The plurality of bond pads further includes a second set of bond pads configured along the first edge and the second edge of the each fluid ejecting chip of the second set of fluid ejecting chips for distributing at least one of power and control signals to fluid ejectors within the each fluid ejecting chip of the second set of fluid ejecting chips. Specifically, the plurality of bond pads includes bond pads 1162 configured along the first edge 1164 and the second edge 1166 of the fluid ejecting chip 1150 for distributing at least one of power and control signals to fluid ejectors (not shown) within the fluid ejecting chip 1150. Similarly, the plurality of bond pads includes bond pads 1182 configured along the first edge 1184 and the second edge 1186 of the fluid ejecting chip 1170 for distributing at least one of power and control signals to fluid ejectors (not shown) within the fluid ejecting chip 1170. Further, the second set of bond pads are capable of distributing the at least one of power and control signals to the fluid ejectors within the each fluid ejecting chip of the second set of fluid ejecting chips through a second set of wires (not shown).

The inkjet printhead 1100 may also include an encapsulant fabricated over the first set of bond pads, such as the bond pads 1122, 1142, 1162, and 1182, in the form of a layer (not shown).

The arrangement of the inkjet printhead 1100 and components thereof facilitates the inkjet printhead 1100 to be considered as a wide swath inkjet printhead because of the close tiling of the fluid ejecting chips 1110, 1130, 1150 and 1170. Further, each bond pad of the plurality of bond pads is positioned along respective skewed edges of the plurality of fluid ejecting chips, in order to provide shorter power/control signals distribution to heater arrays and to allow more space for the plurality of bond pads.

In another aspect, the present disclosure provides an inkjet printhead, such as the inkjet printhead 900, which includes a plurality of fluid ejecting chips (such as the fluid ejecting chips 910, 950, 930 and 970) arranged in a lengthy array, and specifically, in parallel rows of chips, such as rows 902 and 904 (as depicted in FIG. 9). Each fluid ejecting chip of the plurality of fluid ejecting chips includes a first fluid via arranged along the lengthy array. Specifically, the fluid ejecting chip 910 includes the fluid via 916 arranged along the lengthy array. Similarly, the fluid ejecting chip 950 includes the fluid via 960 arranged along the lengthy array. Further, the each fluid ejecting chip, such as the fluid ejecting chips 910 and 950, includes a second fluid via, such as the fluid vias 920 and 956, arranged along the lengthy array. The fluid vias 920 and 956 are substantially parallel to the respective fluid vias 916 and 960. Further, the fluid via 916 and the fluid via 960 have differing lengths as they are positioned on their respective chips. Similarly, the fluid via 920 and the fluid via 956 have lengths different from one another on their respective chips.

Furthermore, respective first fluid vias, such as the fluid vias 916 and 960, of adjacent fluid ejecting chips 910 and 950, are common or of substantially the same length across any two consecutive chips in the array. Similarly, respective second fluid vias, such as the fluid vias 920 and 956, of the fluid ejecting chips 910 and 950, are of substantially same length. The same is true of any other fluid vias on adjacent chips across the lengthy array.

In yet another aspect, the present disclosure provides a fluid ejecting chip (such as the fluid ejecting chips 910, 930, 950 and 970) that includes a plurality of fluid vias (such as the fluid vias 916, 918, 920; 936, 938, 940; 956, 958, 960; and 976, 978, 980, respectively) of varying lengths configured within the fluid ejecting chip. The fluid ejecting chip also includes a plurality of bond pads (such as the bond pads 922, 942, 962 and 972) configured along an edge (such as the respective first edges 912, 932, 952 and 972) of the fluid ejecting chip for distributing at least one of power and control signals to fluid ejectors within the fluid ejecting chip. Further, the plurality of bond pads (such as the bond pads 922, 942, 962 and 972) is configured adjacent to a shortest fluid via (such as the respective fluid vias 916, 936, 956 and 976) of the plurality of fluid vias of varying lengths.

In still another aspect, the present disclosure provides a fluid ejecting chip (such as the fluid ejecting chip 1110, 1130, 1150 and 1170) that includes a plurality of fluid vias (such as the fluid vias 1116, 1118, 1120; 1136, 1138, 1140; 1156, 1158, 1160; and 1176, 1178, 1180, respectively) configured within the fluid ejecting chip. The fluid ejecting chip also includes a plurality of bond pads (such as the bond pads 1122, 1142, 1162, 1182) configured along an edge (such as the first edges 1124, 1144, 1164, 1184) of the fluid ejecting chip for distributing at least one of power and control signals to fluid ejectors within the fluid ejecting chip. Further, the plurality of bond pads (such as the bond pads 1122, 1142, 1162, 1182) is configured adjacent to a periphery (such as respective peripheries 1128, 1148, 1168 and 1188) of the fluid ejecting chip.

Based on the foregoing, the present disclosure provides efficient and cost-effective inkjet printheads, such as the inkjet printheads 900, 1000 and 1100, which may be employed in an inkjet printer for obtaining long print swaths on a print medium. The step pattern of the plurality of fluid vias optimizes power/control signals distribution routing within the plurality of fluid ejecting chips. Specifically, the step pattern of the plurality of fluid vias allows for having the shortest wiring distances from the plurality of fluid vias/heater array (not shown) to the plurality of bond pads in order to distribute power/control signals efficiently on the plurality of fluid ejecting chips in comparison to the prior art arrangement/designs of inkjet printheads. Further, longer print swaths may easily be obtained using the inkjet printheads of the present disclosure in comparison to conventional inkjet printheads.

Furthermore, the arrangement of the inkjet printheads of the present disclosure facilitates in providing a closer fluid ejecting chip tiling to eliminate concerns over encapsulant footprint tolerances. Specifically, by orienting the first set of fluid ejecting chips and the second set of fluid ejecting chips in an alternating manner (180°) and by utilizing a fluid ejecting chip design having stepped fluid vias along with having the plurality of bond pads configured along a fluid ejecting chip's longitudinal edges, as shown in FIGS. 9 and 12 Error! Reference source not found, encapsulant footprints exist far away from neighboring fluid ejecting chips. Such an arrangement allows for minimizing the gap between adjacent rows in which the plurality of fluid ejecting chips are configured, thus minimizing the distances between fluid vias of respective fluid ejecting chips that carry a fluid of the same type/color for better print quality with minimized paper skew effects. In other words, a stepped fluid via design does not require the need to accommodate encapsulant footprint tolerances and thereby allows very close fluid ejecting chip tiling.

Additionally, the present disclosure provides fluid ejecting chips (such as the fluid ejecting chips 910, 930, 950, 970; and 1110, 1130, 1150, 1170) that may be used for fabricating efficient inkjet printheads.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. An inkjet printhead comprising:

a plurality of fluid ejecting chips arranged in a plurality of rows, the plurality of fluid ejecting chips comprising, a first set of fluid ejecting chips arranged in a first row of the plurality of rows, each fluid ejecting chip of the first set of fluid ejecting chips comprising a first edge and a second edge opposite to the first edge, and a second set of fluid ejecting chips arranged in a second row of the plurality of rows, the second row being parallel to the first row, each fluid ejecting chip of the second set of fluid ejecting chips comprising a first edge and a second edge opposite to the first edge, wherein the each fluid ejecting chip of the second set of fluid ejecting chips is configured between two consecutive fluid ejecting chips of the first set of fluid ejecting chips in a predetermined orientation such that the second edge of the each fluid ejecting chip of the second set of fluid ejecting chips is in proximity to a respective second edge of a fluid ejecting chip of the two consecutive fluid ejecting chips preceding the each fluid ejecting chip of the second set of fluid ejecting chips;

a plurality of fluid vias comprising, a first set of fluid vias configured in a stepwise manner within the each fluid ejecting chip of the first set of fluid ejecting chips, and a second set of fluid vias configured in a stepwise manner within the each fluid ejecting chip of the second set of fluid ejecting chips; and a plurality of bond pads comprising, a first set of bond pads configured along at least one of the first edge and the second edge of the each fluid ejecting chip of the first set of fluid ejecting chips for distributing at least one of power and control signals to fluid ejectors within the each fluid ejecting chip of the first set of fluid ejecting chips, and a second set of bond pads configured along at least one of the first edge and the second edge of the each fluid ejecting chip of the second set of fluid ejecting chips for distributing at least one of power and control signals to fluid ejectors within the each fluid ejecting chip of the second set of fluid ejecting chips.

2. The inkjet printhead of claim 1, wherein the first set of fluid vias comprises fluid vias of varying lengths, and wherein a shortest fluid via of the fluid vias of varying lengths is configured in proximity to the first edge of the each fluid ejecting chip of the first set of fluid ejecting chips.

3. The inkjet printhead of claim 2, wherein the first set of bond pads is configured in proximity to the shortest fluid via of the first set of fluid vias.

4. The inkjet printhead of claim 1, wherein the second set of fluid vias comprises fluid vias of varying lengths, and wherein a shortest fluid via of the fluid vias of varying lengths is configured in proximity to the first edge of the each fluid ejecting chip of the second set of fluid ejecting chips.

5. The inkjet printhead of claim 4, wherein the second set of bond pads is configured in proximity to the shortest fluid via of the second set of fluid vias.

6. The inkjet printhead of claim 1, wherein the predetermined orientation corresponds to an alignment of the each fluid ejecting chip of the second set of fluid ejecting chips at an angle of about 180 degrees with respect to each fluid ejecting chip of the two consecutive fluid ejecting chips of the first set of fluid ejecting chips.

7. The inkjet printhead of claim 1, wherein a fluid via of the first set of fluid vias configured in proximity to the first edge of the each fluid ejecting chip of the first set of fluid ejecting chips and a fluid via of the second set of fluid vias configured in proximity to the second edge of the each fluid ejecting chip of the second set of fluid ejecting chips, are adapted to carry a fluid of a first type.

8. The inkjet printhead of claim 7, wherein a fluid via of the first set of fluid vias configured in proximity to the second edge of the each fluid ejecting chip of the first set of fluid ejecting chips and a fluid via of the second set of fluid vias configured in proximity to the first edge of the each fluid ejecting chip of the second set of fluid ejecting chips, are adapted to carry a fluid of a second type.

9. The inkjet printhead of claim 1, further comprising an encapsulant fabricated over the first set of bond pads.

10. The inkjet printhead of claim 1, wherein the first set of bond pads distributes the at least one of power and control signals to the fluid ejectors within the each fluid ejecting chip of the first set of fluid ejecting chips through a first set of wires.

11. The inkjet printhead of claim 1, further comprising an encapsulant fabricated over the second set of bond pads.

12. The inkjet printhead of claim 1, wherein the second set of bond pads distributes the at least one of power and control signals to the fluid ejectors within the each fluid ejecting chip of the second set of fluid ejecting chips through a second set of wires.

13. The inkjet printhead of claim 1, wherein the first edge and the second edge of the each fluid ejecting chip of the first set of fluid ejecting chips are longitudinal straight edges.

14. The inkjet printhead of claim 13, wherein the first edge and the second edge of the each fluid ejecting chip of the second set of fluid ejecting chips are longitudinal straight edges.

15. The inkjet printhead of claim 1, wherein the first edge of the each fluid ejecting chip of the first set of fluid ejecting chips has slanted end portions, and wherein the second edge of the each fluid ejecting chip of the first set of fluid ejecting chips is a longitudinal straight edge.

16. The inkjet printhead of claim 15, wherein the first set of bond pads are configured along the slanted end portions of the first edge of the each fluid ejecting chip of the first set of fluid ejecting chips.

17. The inkjet printhead of claim 15, wherein the first edge of the each fluid ejecting chip of the second set of fluid ejecting chips has slanted end portions, and wherein the second edge of the each fluid ejecting chip of the second set of fluid ejecting chips is a longitudinal straight edge.

18. The inkjet printhead of claim 17, wherein the second set of bond pads are configured along the slanted end portions of the first edge of the each fluid ejecting chip of the second set of fluid ejecting chips.

19. The inkjet printhead of claim 1, wherein the first edge and the second edge of the each fluid ejecting chip of the first set of fluid ejecting chips, and the first edge and the second edge of the each fluid ejecting chip of the second set of fluid ejecting chips, are skewed edges.

20. An inkjet printhead comprising:

a plurality of fluid ejecting chips arranged in a lengthy array, each of the plurality of fluid ejecting chips comprising, a first fluid via arranged along the lengthy array, and a second fluid via arranged along the lengthy array, the second fluid via being substantially parallel to the first fluid via, wherein the first and second fluid vias have differing lengths across any one of the fluid ejecting chips but an overall length is substantially common between adjacent said first fluid vias and adjacent said second fluid vias on consecutive said ejecting chips.

21. A fluid ejecting chip comprising:

a plurality of fluid vias of varying lengths configured within the fluid ejecting chip; and a plurality of bond pads configured along an edge of the fluid ejecting chip for distributing at least one of power and control signals to fluid ejectors within the fluid ejecting chip, further the plurality of bond pads being configured adjacent to a shortest fluid via of the plurality of fluid vias of varying lengths.

* * * * *